US005999788A

United States Patent [19]

Kanesawa et al.

[11] Patent Number: 5,999,788

[45] Date of Patent: Dec. 7, 1999

[54] FIXING DEVICE AND IMAGE FORMING APPARATUS

[75] Inventors: Yoshio Kanesawa; Hirotaka Matsuoka; Yasuhiro Kusumoto; Yasuhiro Uehara, all of Nakai-machi, Japan

[73] Assignee: Fuji Xerox Co. Ltd., Tokyo, Japan

[21] Appl. No.: 09/181,614

[22] Filed: Oct. 28, 1998

[30] Foreign Application Priority Data

Oct. 30, 1997 [JP] Japan ..... 9-298998

[51] Int. Cl.[6] ..... G03G 15/20

[52] U.S. Cl. ..... 399/329; 219/216; 399/333

[58] Field of Search ..... 399/329, 328, 399/330, 333; 219/216; 432/60

[56] References Cited

U.S. PATENT DOCUMENTS

| | | | |
|---|---|---|---|
| 5,345,300 | 9/1994 | Uehara et al. | 399/329 |
| 5,359,401 | 10/1994 | Uehara et al. | 399/329 |
| 5,614,999 | 3/1997 | Kanesawa et al. | 399/329 |
| 5,621,512 | 4/1997 | Uehara et al. | 399/328 |
| 5,666,624 | 9/1997 | Kanesawa et al. | 399/329 |
| 5,737,679 | 4/1998 | Uehara et al. | 399/329 |
| 5,866,875 | 2/1999 | Okabayashi | 219/216 |
| 5,873,020 | 2/1999 | Matsuura et al. | 399/329 |

FOREIGN PATENT DOCUMENTS

| | | |
|---|---|---|
| 53-144747 | 12/1978 | Japan . |
| A-57-89785 | 6/1982 | Japan . |
| A-61-22376 | 1/1986 | Japan . |
| B2-7-349 | 1/1995 | Japan . |

*Primary Examiner*—Richard Moses
*Attorney, Agent, or Firm*—Oliff & Berridge, PLC

[57] ABSTRACT

A fixing device comprises a heat fixing roller in which a heat resistant elastic layer is formed on a cylindrical metal core and, further, a heat resistant resin layer is coated on the surface thereof, an endless belt, a pressure member disposed in the inside of the endless belt, wherein the endless belt is wound around the heat fixing roller for a predetermined angle to form a nip area between the endless belt and the heat fixing roller for allowing a recording sheet to pass therethrough, the pressure member is pressed by way of the endless belt to the heat fixing roller at the nip area thereby forming distortion in the heat resistant elastic layer of the heat fixing roller. An image forming apparatus using the fixing device can satisfy improved image quality, extended working life, energy saving and high speed operation altogether.

18 Claims, 14 Drawing Sheets

Comparison of fixing latitude between fluoro resin roll and bitone roll

FIXING DEVICE AND IMAGE FORMING APPARATUS

BACKGROUND OF THE INVENTION

1. Field of the Invention

The present invention relates to a fixing device used in an image forming apparatus utilizing an electrophotographic system, for example, a copier, a printer or a facsimile unit, as well as an image forming apparatus using the fixing device described above.

2. Prior Art

In a copier or printer utilizing the electrophotographic system, it is necessary to fix unfixed toner images formed on a recording sheet into permanent images, and a solvent fixing method, a pressure fixing method and a heat fixing method have been known for the fixing method.

However, the solvent fixing method involves a drawback that evaporating solvent vapors result in malodors or hygienic problems. On the other hand, the pressure fixing method involves a drawback that the fixing property is poor compared with other fixing methods and the pressure sensitive toner is expensive. In view of the above, both of the methods are scarcely put to practical use at present. Therefore, a heat fixing method of melting a toner by heating and heat fusing the same on a recording sheet has been adopted generally.

A heat roll type device has been known as a device by the heat fixing method, which comprises, as shown in FIG. 12, a fixing roller 121 having a heating source 123 in the inside of a cylindrical metal core 122 and a releasing layer 124 formed on the outer circumferential surface of the cylindrical metal core 122, and a pressure roller 125 having a cylindrical metal core 126, and a heat resistant elastic layer 127 and a releasing layer 128 made of a heat resistant resin film or a heat resistant rubber film formed on the outer circumferential surface of the cylindrical metal core 126. A recording sheet carrying unfixed toner images thereon (not illustrated) is passed between the fixing roller 121 and the pressure roller 125 to fix the toner images under heating and pressure. Since the heat roll system has a higher heat efficiency and suffers from less worry of paper burning caused by clogging compared with other heat fixing methods, for example, a heat radiation type fixing system, it has been utilized most generally at present.

The releasing layer 124 of the fixing roller 121 is made of a heat resistant resin film or heat resistant rubber film such that the toner images after fixing are easily stripped from the fixing roller 121. For the material of the releasing layer 124, it has been known generally that heat resistant resins typically represented by polytetrafluoroethylene (hereinafter referred to as "PTFE"), perfluoro alkyl vinyl ether polymer (hereinafter referred to as "PFA") and polytetrafluoroethylene hexafluoro propylene copolymer (hereinafter referred to as "FEP") can provide higher releasing performance without using a releasing agent (so-called releasing oil), compared with heat resistant rubber typically represented by silicone rubber or fluoro rubber. Accordingly, such heat resistant resins are generally used as the releasing layer in black and white copiers.

However, the fixing device in the full color copier or printer involves problems in view of the following points and the prior art described above cannot overcome such problems altogether.

1. Subject on Image Quality

When a fluoro resin is coated as a layer on the cylindrical metal core, since the material of the fluoro resin per se is rigid, this results in the following problems in view of the image quality.

FIG. 13 is an enlarged cross sectional view schematically showing the state of a fixing roller 131, a recording sheet 132 and a toner image 133 during fixing. As shown in FIG. 13, the toner image 133 has unevenness when viewed microscopically, so that it cannot follow after the fixing roller 131 if the roller is hard and adhesion in a microscopic state is deteriorated. Therefore, the toner image 133 after fixing causes minute unevenness of gloss in a solid area between a portion in contact with the fixing roller 131 and another portion not in contact therewith. Since the demand for the image quality in the black and white copier is not so high compared with that of the full color copier, use of the fixing roller comprising the metal core coated with the fluoro resin described above was satisfactory.

On the contrary, in the full color copier, demand for the image quality is much greater compared with that for the black and white copier. Accordingly, in the full color copier, the molecular weight of a binder resin is usually lowered so that the resin is easily deformable. This helps make the toner surface flat after fixing thereby attaining a high image quality. Furthermore, for suppressing unevenness of gloss, the cylindrical metal core is coated with heat resistant rubber, thereby, to improving the adhesion of the fixed image with the toner layer due to the stretchability of rubber per se and attaining excellent image quality with no unevenness of gloss.

2. Subject on Releasability and Reliability

A binder resin for the toner used in the black and white copier has a large molecular weight and shows elastic behavior. Therefore, the binder resin itself has good releasability with the fixing roller.

However, in the full color copier, a binder resin of lower molecular weight and showing strongly viscous behavior is used for the toner in view of the demand for the improvement of the image quality. Further, since the adhesion between the surface of the fixing roller and the toner is increased with an aim of eliminating unevenness of gloss, the area of contact between the fixing roller and the toner is enlarged to increase the deposition force. In the full color copier, since a toner of four colors, namely, yellow, magenta, cyan and black is used, the deposition force is further increased.

Therefore, the fluoro resin roller used in the black and white copier has poor releasability and cannot release the toner from that fixing roller.

In view of the above as disclosed in Japanese Published Unexamined Patent Application No, Hei 5-150679, it has been adopted a method of covering a fixing roller with heat resistant rubber and forming distortion in the fixing roller thereby obtaining high releasing performance. FIG. 14 is a side cross sectional view illustrating such a fixing device. A fixing roller 141 comprises a cylindrical metal core 142 and a releasing layer 144 made of a heat resistant resin film or a heat resistant rubber film formed on the circumferential surface of the cylindrical metal core 142. Reference numeral 145 denotes a pressure roller. In this fixing device, heating sources 146, 147 are disposed at the inside in both of the fixing roller 141 and the pressure roller 145.

"Distortion" means herein distortion formed on the surface of the heat resistant rubber layer 143 when the pressure roller 145 is in press contact with the fixing roller 141 and the heat resistant rubber layer 143 of the fixing roller 141 deforms elastically.

The fixing roller as disclosed in Japanese Published Unexamined Patent Application No. Hei 5-150679 has a structure in which an LTV silicone rubber layer is formed on a cylindrical metal core and, an RTV silicone rubber layer is formed as a releasing layer further thereon. Since the RTV silicone rubber layer per se at the outermost layer has an expandability, the distortion tends to be formed.

However, releasability of rubber itself is not so high and, in order to ensure sufficient releasability, a releasing oil has to be coated or supplied separately to the releasing layer of the fixing roller. That is, when the releasing oil is coated, the toner is released from the fixing roller due to the intra-layer separation of the oil layer. At present, a fixing device having a rubber roller using such a releasing oil has been adopted in most of full color copiers.

However, since the releasing oil is used, this has resulted in problems such as swelling of the silicone rubber with oil, leakage of the oil in the device, deterioration of easy writing by a ball point pen or ink caused by the oil on the recording sheet after fixing. Further, maintenance such as periodical supplement of the oil is also necessary, which is not suitable to a small-sized full color copier or a printer. Further, since the friction coefficient of the silicone rubber is high, there are also problems of abrasion in the releasing layer by the passage of sheets or deterioration in the releasability caused by the denaturation of the silicone rubber per se.

Accordingly, it is considered that if a fluoro resin having high releasability by itself is coated on the heat resistant rubber layer, high releasability can be obtained and no additional releasing oil coating unit is necessary. Namely, it is considered that an excellent image quality can be obtained together with high releasability by use of a fixing roller comprising heat resistant rubber on which a fluoro resin is dispersion-coated and baked as disclosed in, for example, Japanese Published Unexamined Patent Application No. Sho 61-22376 and Japanese Published Unexamined Patent Application No. Sho 61-248731. However, since the coated and baked film as disclosed above has a thickness of about 2 to 3 $\mu$m and since pressure by the pressure roller is high, it results in a problem that the releasability is lowered by the frictional abrasion of the releasing layer caused by the passage of sheets.

The problem of the frictional abrasion can be overcome by covering the surface of the heat resistant rubber with a previously prepared fluoro resin tube as disclosed, for example, in Japanese Published Unexamined Patent Application No. Sho 57-89785, Japanese Published Unexamined Patent Application No. Sho 53-114474, Japanese Published Examined Patent Application No. Hei 7-349, and Japanese Published Unexamined Patent Application No. Hei 4-42183. However, since the thickness of a usual fluoro resin tube is from about 50 to 100 $\mu$m, the tube itself is rigid and it is difficult to form the distortion described above and a purpose of attaining high releasability and an excellent image quality cannot be attained satisfactorily.

Further, if a fluoro resin layer is disposed on the surface of the heat resistant rubber to provide further distortion, the releasability can be improved. However, since the shrinkage is different between the rubber and the resin, if large distortion is given, the fluoro resin causes plastic deformation to result in creasing. Namely, in the existent fixing device using the heat/pressure roller pair, since stripping is conducted by providing a relatively thick rubber layer with large distortion, if a fluoro resin layer is additionally disposed, it may possibly result in creasing. Since the fluoro resin layer tends to cause more creasing as the layer thickness is reduced, the problem of creasing becomes conspicuous if it is intended to use a thinner fluoro resin layer in order to improve the image quality and the releasability.

3. Subject of Energy Saving and High Speed Fixing

Further, when the fixing roller 141 and the pressure roller 145 are brought into press contact with each other, to ensure a wide nip and form large distortion as in the fixing device shown in FIG. 14, it is necessary to increase the wall thickness of the cylindrical metal core 142 of the fixing roller 141 and also increase the wall thickness of the heat resistant rubber layer 143 disposed thereon. Accordingly, this necessarily increases the heat capacity of the fixing device and it takes about three to six minutes as a temperature rising time from a room temperature. Therefore, it is necessary keep the fixing device at a somewhat high temperature also in a stand-by state in which images are not formed, and a most portion of the electric power consumption in the copier or the like is caused by this preheating at present.

Further, presence of a thick rubber layer having low heat conductivity gives extremely high heat resistance from the inner circumferential surface to the outer circumferential surface of the fixing roller 141. Accordingly, even if the heater 146 in the fixing roller 141 is heated, the heat is not conducted easily to the outer circumferential surface of the fixing roller 141. This gives a hindrance in the increase of the operation speed of the fixing device.

A fixing device having a rapid temperature rising characteristic (hereinafter referred to as "instant starting performance") by using a thin film and a fixed heater has already been disclosed (although in a black and white fixing device) in, for example, Japanese Published Unexamined Patent Application Nos. Sho 63-313182 and Hei 4-44074. However, the technique cannot provide high image quality and high speed adaptability to operation required for full color fixing. This is because the fixing device described just above adopts a system of conducting heat from the heater to a recording sheet by way of the thin film having a heat capacity substantially equal with zero, so that heat conduction is worsened if an elastic layer is disposed on the film for improving the image quality and, after all, the device cannot be adopted in a system.

As described above, respective problems have been solved individually but a fixing device capable of satisfying the problems altogether has not yet been attained.

SUMMARY OF THE INVENTION

It is an object of the present invention to provide a fixing device of high reliability capable of attaining high releasability and an excellent image quality, with no problems such as creasing in a releasing layer on a fixing roller, frictional abrasion and degradation, and lowering in the releasability, as well as provide an image forming apparatus using such a fixing device. Another object of the invention is to provide a fixing device capable of reducing the heat capacity of the fixing device thereby shortening the temperature rising time and capable of decreasing the heat resistance of a fixing roller, thereby attaining instant starting performance and high speed operation, as well as provide an image forming apparatus using such a fixing device. Namely, it is a practical object of the present invention to satisfy improvement of the image quality, extension of the working life, energy saving and high speed operation of the image forming apparatus.

The foregoing objects can be attained in accidence with the present invention by:

(1) a fixing device comprising:

a heat fixing roller in which a heat resistant elastic layer is formed on a cylindrical metal core and, further, a heat resistant resin layer is coated on the surface thereof;

an endless belt;

a pressure member disposed in the inside of the endless belt;

wherein the endless belt is wound around the heat fixing roller for a predetermined angle to form a nip area between the endless belt and the heat fixing roller for allowing a recording sheet to pass therethrough, the pressure member is pressed by way of the endless belt to the heat fixing roller at the nip area thereby forming distortion in the heat resistant elastic layer of the heat fixing roller.

Since the heat resistant resin layer is coated as a releasing layer on the heat resistant elastic layer of the heat fixing roller, and distortion is given to the heat fixing roller, a high image quality can be attained while obtaining high releasability without using a releasing agent such as a silicone oil. The heat resistant resin causes less degradation in the releasability and maintains the releasability for a long period of time. Further, since the endless belt is wound around the heat fixing roller to form the nip area, a wide nip area can be obtained under a lower roll compared with a load pair fixing system. Accordingly, since the rigidity of the metal core of the fixing roller may be lower and the heat capacitance can be reduced, the instant starting performance can be improved. Further, since the load on the nip area can be reduced, frictional abrasion of the heat resistant resin layer can be decreased remarkably.

(2) In the fixing device as defined in (1) above, the heat resistant resin layer comprises a fluoro resin.

Since the fluoro resin at high hardness is used as the heat resistant resin layer, the degradation for the releasability less occurs, so that the working life of the fixing device can be extended.

(3) In the fixing device as defined (1) or (2) above, the pressure member comprises a pressure pad ("pressure pad" means in the present invention a member for giving phase-to-phase urging to a portion for the circumferential surface of the heat fixing roller), and the pressure pad is pressed by way of an endless belt to the heat fixing roller thereby forming distortion in the elastic layer of the heat fixing roller.

By using the pressure pad for the pressure member, the size of the device can be reduced.

(4) In the fixing device as defined in (3) above, a pressure at the nip caused by the pressure pad that presses the fixing roller is locally increased near the exit of the nip area.

Since the distortion of the fixing roller is increased locally near the exit of the nip area, high releasability can be obtained with a small amount of distortion compared with a case of causing the distortion over the entire nip area as in the roll pair fixing system. Accordingly, creasing can be prevented even in a case of using a thin film heat resistant resin layer, stripping between the heat resistant elastic layer and the releasing layer of the heat resistant resin is less likely to occur, providing longtime reliability in conjunction with keeping of the releasability.

Further, since a small amount of distortion may suffice, the thickness of the heat resistant elastic layer of the fixing roller can be reduced. Since this contributes to the reduction of the heat capacity of the fixing roller, the instant starting performance can be better improved, and the electric power consumption can also be decreased. Since the thickness of the heat resistant elastic layer with poor heat conductivity can be reduced, the heat resistance between the inner surface and the outer surface of the fixing roller can be decreased to obtain a high thermal response. Accordingly, fixing at higher speed is enabled.

Furthermore, since the small amount of distortion may suffice, frictional abrasion of the heat resistant resin layer can be reduced.

(5) In the fixing device as defined in (1) or (2) above, the endless belt is wound around the heat fixing roller for a predetermined angle in a state where the belt is laid around a plurality of support rollers and at least one of the support rollers is pressed, as a pressure roller, to the heat fixing roller by way of the endless belt near the exit of the nip area.

With the constitution described above, since the endless belt is not brought into sliding movement, fixing at high speed is possible.

(6) In a fixing device as defined in the (1) to (5) above, the distortion of the heat fixing roller in the nip area is from 0.1% to 4%.

When the amount of distortion is decreased as described above, the thickness of the heat resistant elastic layer of the fixing roller can be reduced. Since this contributes to the reduction of the heat capacity of the fixing roller, the instant starting performance can be better improved. Since the thickness of the heat resistant elastic layer with poor heat conductivity can be reduced, the heat resistance between the inner surface and the outer surface of the fixing roller can be decreased to obtain a high thermal response. Accordingly, fixing at higher speed is enabled.

(7) In a fixing device as defined in any one of (1)–(6) above, the thickness of the heat resistant resin layer of the fixing roller is from 5 $\mu$m to 40 $\mu$m.

Since the thickness of the heat resistant resin layer is reduced, distortion of the heat resistant elastic layer in the nip area is caused effectively to improve the releasability.

(8) In a fixing device as defined in any one of (1) to (7) above, a releasing sheet having a width of contact which is substantially identical with the axial length of the heat fixing roller is provided, the releasing sheet is situated at the downstream of the nip area in the rotating direction of the heat fixing roller, and disposed in a direction opposite to the rotating direction of the heat fixing roller and in a state in which the top end and/or the vicinity of the top end thereof is in contact with the outer circumferential surface of the heat fixing roller.

Since the releasing sheet as an auxiliary unit for stripping the recording sheet from the heat fixing roller is made wider, preferably, it is disposed for the entire sheet passing area, even if the toner images on the recording sheet are in contact with the releasing sheet, force exerting per unit area is small, so that the toner images is not damaged and the recording sheet can be released satisfactorily from the heat fixing roller.

(9) In a fixing device as defined in (8) above, the releasing sheet uses a heat resistant plastic sheet or a thin metal sheet as a substrate, and the both surfaces and the top end of the substrate are coated with a fluoro resin.

Since the releasing sheet coated at the surface with the fluoro resin is used, the working life of the releasing sheet can be extended due to the hardness of the fluoro resin.

(10) An image forming apparatus comprising an electrostatic latent image forming unit that forms electrostatic latent images on an electrostatic latent image support, a developing unit that develops the electrostatic latent images by toner, a transfer unit that transfers developed toner images onto a recording sheet and a fixing unit that fixes transferred toner images to the recording sheet, wherein the fixing unit is the fixing device as defined in any one of (1) to (9) above.

Since the fixing device as defined in any one of (1) to (9) above is used as the fixing unit for the image forming apparatus, it is possible to satisfy an improved image quality, an extended working life, energy saving and high speed operation of the image forming apparatus altogether.

(11) In an image forming apparatus as defined in (10) above, the toner comprises at least a colorant, a binder resin and 0.1 to 40% by weight of a wax.

Since the was is incorporated in the toner, wider fixing latitude can be obtained even in a case applied to the fixing device in (1) above not using the releasing oil on the surface of the heat fixing roller. Further, since the width of the nip area can be made wider in the fixing device of (1) above, the wax exudes sufficiently to obtain satisfactory releasability in a case of fixing the toner images with the wax-containing the toner.

(12) In an image forming apparatus as defined in (11) above, the dispersed diameter of the wax is 2 $\mu$m or less on the number average basis.

Since the dispersed diameter of the wax is reduced, the image transparency is not worsened even in a case of forming the images on a transparency film (OHP film).

(13) In a image forming apparatus as defined in (11) or (12) above, the melting point of the wax is 110° C. or lower.

Since the melting point of the wax is made somewhat lower than the melting point of the binder resin in the toner, the wax is effectively leached out of the toner prior to the binder resin, present on the boundary between the toner and the heat fixing roller upon stripping at the exit of the nip area, thereby contributing effectively to improvement of the releasability.

(14) In an image forming apparatus as defined in (11) or (12) above, the latent heat of melting of the wax is 230 mJ/mg or less.

Since, the latent heat of melting like that the melting point of the wax is made somewhat lower than that the melting point of the binder resin in the toner, the wax is effectively leached out of the toner prior to the binder resin, present on the boundary between the toner and the heat fixing roller upon stripping at the exit of the nip area, thereby contributing effectively to improvement of the releasability.

(15) In an image forming apparatus as defined in (10) above, at least a portion of the binder resin in the toner comprises a mixture of a linear polymer having a weight average molecular weight of 2,000 to 50,000 and a non-linear polymer having a weight average molecular weight of 2,000 to 50,000 in which the mixing ratio (linear polymer: non-linear polymer, weight ratio) is from 40:60 to 99:1.

With such constitution of the binder resin in the toner, the linear polymer can ensure satisfactory fixing property to the recording sheet, while the non-linear polymer can ensure satisfactory releasability from the heat fixing roller, respectively. Since the cross-linked polymer (non-linear polymer) is used within a preferred range as the binder resin for the toner, the smoothness and the gloss of the fixed images are not substantially deteriorated and the toner is not made less fusible. That is, there is no requirement to set a high temperature to the heat fixing roller, and there is no disadvantage to the high speed fixing property.

(16) In an image forming apparatus as defined in (15) above, the glass transition point of the linear polymer in the binder resin is from 40 to 80° C. and the difference of the glass transition point thereof with that of the non-linear polymer in the binder resin is 20° C. or less.

Since the glass transition point of the linear polymer and the non-linear polymer in the binder resin is controlled as described above, the toner characteristics such as gloss can be made satisfactory.

(17) In an image forming apparatus as defined in (15) above, the softening point of the linear polymer in the binder resin is from 90 to 120° C. and the difference of the softening point thereof with that of the non-linear polymer is 20° C. or less.

Since the softening point of the linear polymer and the non-linear polymer in the binder resin is controlled as described above, the toner characteristics such as gloss can be made satisfactory.

(18) In an image forming apparatus as defined in (15) to (17) above, the linear polymer and non-linear polymer are polyester.

When the polyester is used for the linear polymer and the non-linear polymer, images having high surface smoothness and excellent transparency can be formed even if the molecular weight is high and there is no problem in view of the safety of the material per se.

BRIEF DESCRIPTION OF THE ACCOMPANYING DRAWINGS

PREFERRED EMBODIMENTS OF THE INVENTION

The present invention will be explained specifically referring to preferred embodiments of the invention. In the subsequent descriptions, "heat fixing roller" is merely described as "fixing roller".

A: Constitution of a Fixing Device (First Embodiment of a Fixing Device)

Figure 1:
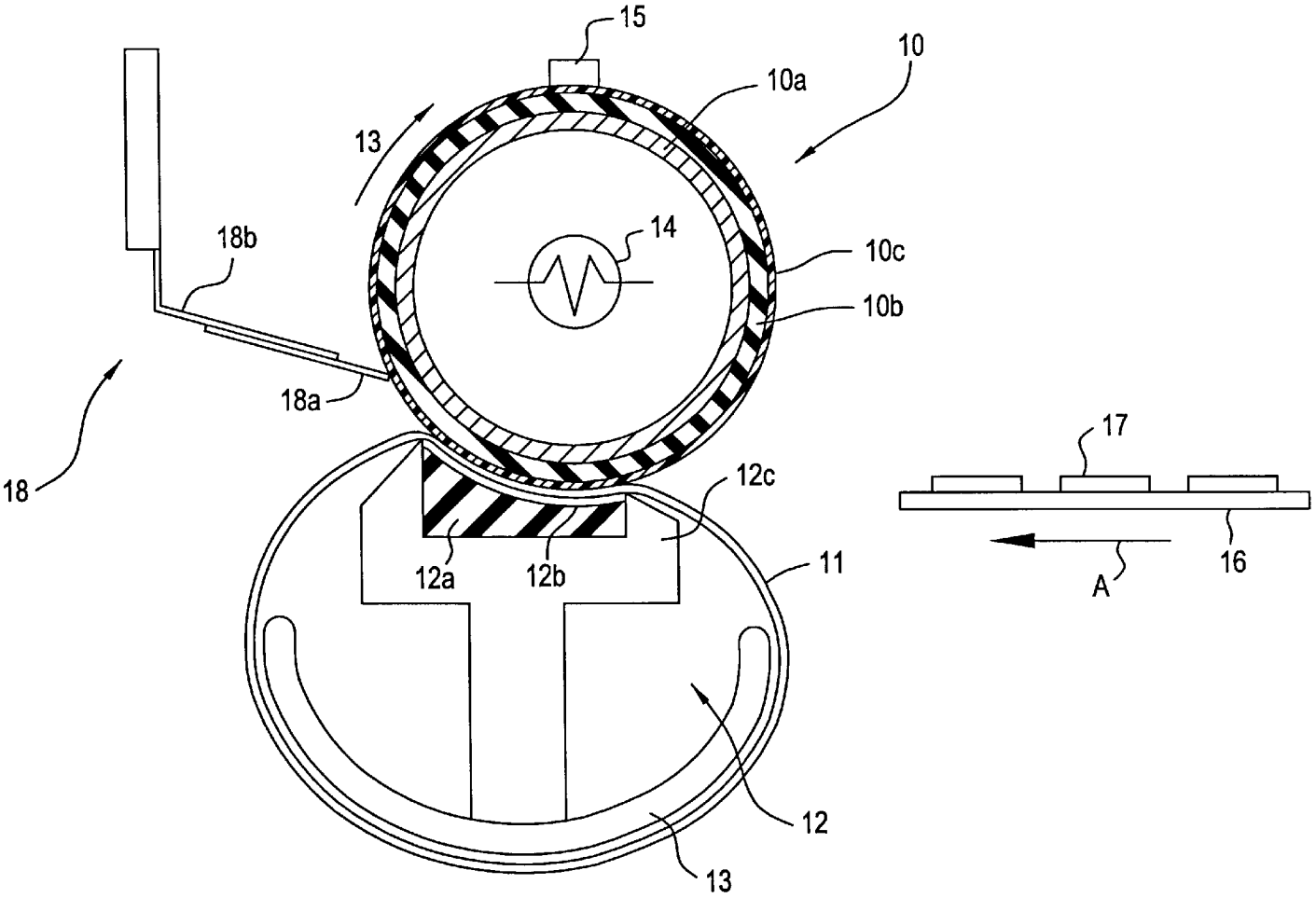
FIG. 1 is a side cross sectional view illustrating a first embodiment of a fixing device according to the present invention.

FIG. 1 is a side cross sectional view illustrating a first embodiment of a fixing device according to the present invention. A main portion comprises fixing roller 10, an endless belt 11, and a pressure pad (pressure member) 12 pressed by way of the endless belt 11 to the fixing roller 10.

The fixing roller 10 comprises a metal core (cylindrical metal core) 10*a,* and a heat resistant elastic layer 10*b* and a releasing layer (heat resistant resin layer) 10*c* formed therearound in which a halogen lamp 14 is disposed in the inside of the core 10*a*.

The temperature at the surface of the fixing roller 10 is measured by a temperature sensor 15, and the halogen lamp 14 is put to feedback control by a measuring signal by way of a temperature controller not illustrated and adjusted such that the surface of the fixing roller 10 is kept at a constant temperature.

The endless belt 11 is in contact with the fixing roll 10 so as to be wound around for a predetermined angle to form a nip area.

A pressure pad 12 is disposed at the inside of the endless belt 11 in a state urged by way of the endless belt 11 to the fixing roller 10.

The pressure pad 12 comprises an elastic member 12*a* for ensuring a large width nip area and a low friction layer 12*b* formed on the surface of the elastic member 12*a* in contact with the inner circumferential surface of the endless belt 11 and the pad is held on a holder 12*c* made of metal and the like. The elastic member 12*a* having the low friction layer 12*b* on the surface has a concaved shape substantially conforming with the outer circumferential surface of the fixing roller 10, is urged to the fixing roller 10 to form a nip area and causes a predetermined amount of distortion to the fixing roller 10. Further, a belt running guide 13 is attached to the holder 12*c* so as to slidably rotate the endless belt 11 smoothly. The belt running guide 13 is desirably composed of a material of a low friction coefficient in view of sliding contact with the inner surface of the endless belt 11 and preferably made of a material of a low heat conduction so as to deprive the endless belt 11 of less heat.

The fixing roller 10 is rotated in the direction of an arrow B by a motor (not illustrated) and the endless belt 11 is also driven to rotate by this rotation.

A toner image 17 is transferred on a recording sheet 16 by a transfer device (not illustrated), and the recording sheet 16 is conveyed from the right of the drawing toward the nip area (in the direction of an arrow A). The toner image 17 on the recording sheet 16 passed through the nip area is fixed by a pressure exerting on the nip area and by heat given from the halogen lamp 14 through the fixing roller 10. When fixing is conducted by the device of the constitution shown in FIG. 1, a wide nip area can be made available, so that stable fixing performance can be ensured.

While the recording sheet 16 after fixing can be stripped satisfactorily, without winding around the fixing roller 10, by the effect of the releasing layer 10*c* and the distortion in the nip area, it is desirable to dispose a stripping unit 18 at the down stream of the nip area in the rotating direction of the fixing roller 10 as an auxiliary stripping unit. The stripping unit 18 is constituted with a releasing sheet 18*a* which is held by a guide 18*b* in contact with the fixing roller 10 in a direction opposed to the rotating direction of the fixing roller 10 (reverse direction).

Respective constitutions will be explained specifically.

As the core 10*a*, a metallic cylinder having high heat conductivity made of iron, aluminum or stainless steel can be used. For the outer diameter and the thickness of the core 10*a,* a small size and a thin thickness can be adopted since the pressing force of the pressure pad 12 is small in the fixing device of the present invention. More specifically, a core of about 20 to 35 mm in the outer diameter and about 0.3 to 0.5 mm in the thickness can be used in a case of an iron pad. It will be apparent that the optimal size may be determined optionally since the strength and the heat conductivity are different depending on the material to be used.

Any of highly heat resistant elastic materials can be used as the heat resistant elastic layer 10*b* formed on the surface of the core 10*a*. Particularly, an elastic material such as rubber or elastomer having a rubber hardness of about 25 to 40° (JIS-A) is preferably used and, specifically, there can be mentioned silicone rubber or fluoro rubber. Among them, PFA is optimum in view of the heat resistance and the processability. The thickness of the heat resistant elastic layer 10*b* is preferably about from 0.3 to 1.0 mm while it may depend on the rubber hardness of the material used.

In the fixing device according to the present invention, since the nip area is wide to obtain sufficient fixing performance and releasability can be obtained effectively with a small amount of distortion, the total load by the pressure pad 12 can be decreased and the thickness of the heat resistant elastic layer 10*b* can be reduced.

As described above, since it is possible to reduce the outer diameter and the wall thickness of the core 10*a* and the thickness of the heat resistant elastic layer 10*b* formed on the surface of the core 10*a* can also be reduced in the fixing device according to the present invention, the heat capacity is significantly lower to improve the instant starting performance and/or lower the output of the halogen lamp 14 as a heating source compared with the fixing device of the existent roll pair system. Further, the heat resistance between the inner surface and the outer surface of the fixing roller 10 can be lowered to make the heat response faster. Accordingly, it is possible to decrease the consumption power and conduct fixing at higher speed.

Any of heat resistant resins may be used for the releasing layer (hear resistant layer) 10*c* formed on the heat resistant elastic layer 10*b* and, for example, a fluoro resin or a silicone resin may be mentioned. Use of the fluoro resin is particularly preferred in view of the releasability and the frictional abrasion of the releasing layer 10*c*. The fluoro resin usable herein can include, for example, PFA (perfluoro alkyl vinyl ether copolymer resin), PTFE (polytetrafluoroethylene) and FEP (tetrafluoroethylene hexafluoro propylene copolymer resin), PFA being the most suitable in view of heat resistance and processability. The thickness of the releasing layer 10*c* is, preferably, from 5 to 30 $\mu$m and, more preferably, 10 to 20 $\mu$m. If the thickness of the releasing layer 10*c* is less than 5 $\mu$m, creasing due to distortion of the fixing roller 10 may possibly be caused. On the other hand, if it exceeds 30 $\mu$m, the releasing layer 10*c* becomes rigid to possibly cause image defects such as uneven gloss. Neither case is desirable. Any of known methods can be adopted as the method of forming the releasing layer 10*c* and the there can be mentioned, for example, dip coating, spray coating, roll coating, bar coating and spin coating.

The endless belt 11 preferably comprises a base layer and a releasing layer covered on the surface thereof (on the surface in contact with the fixing roll 10 or on both surfaces). The base layer is selected, for example, from polyimide, polyamide and polyamide imide and the thickness is, preferably, about from 50 to 120 μm and, more preferably, about from 75 to 100 μm. The releasing layer formed on the surface of the base layer is preferably a fluoro resin, for example, PFA as described above and coated to a thickness of 5 to 20 μm.

The winding angle of the endless belt 10 for the fixing roll 10, while varying depending on the rotational speed of the fixing roll 10, is preferably about 20 to 45° so as to ensure a sufficiently wide nip area. Further, it is preferred that the winding angle is such that the dwell time in the nip area (passing time of the recording sheet) is 30 msec. or more, particularly, about 50 to 70 msec.

As described above, by the use of the endless belt 11 capable of being driven following after the shape of the fixing roll 10, the width for the nip area can be made wider to improve the fixing property and the releasability of the toner.

As described above, the pressure pad 12 comprises the elastic member 12*a,* the low friction layer 12*b,* and the holder 12*c.*

The elastic member 12*a* can be made of an elastic plate, a leaf spring and the like as explained for the heat resistant elastic layer 10*b* of the fixing roller 10 and has a concaved shape substantially conforming with the outer circumferential surface of the fixing roller 10. Further, the low friction layer 12*b* formed on the elastic member 12*a* is disposed so as to lower the sliding resistance between the inner circumferential surface of the endless belt 11 and the pressure pad 12 and desirably has small friction coefficient and high abrasion resistance. Specifically, Teflon-impregnated glass fiber sheet, fluoro resin sheet and resins as explained for the releasing layer 10*c* of the fixing roller 10 can be used.

The pressure pad 12 as described above is pressed to the fixing roller 10 to form a nip area and cause a predetermined amount of distortion to the fixing roller 10. There is no particular restriction on the total load of the pressure pad 12 so long as it is within such a range as capable of obtaining a desired amount of distortion. Since the nip area is wide in the fixing device of the present invention, a sufficient amount of distortion can be obtained even with a small total weight providing that the load is gradually increased from the inlet to the exit of the nip area.

"Distortion" is as has been described above and the amount of distortion in the present invention is measured as described below.

Generally, when a hard roller and a soft roller are in press contact with each other under a certain load, the surface of the soft roller deforms elastically in a press-contacted nip region, and circumferential distortion is resulted to the surface. When the roller pair are rotated in this state and a recording sheet is passed therethrough, the recording sheet is transported in a region of the soft roller where distortion is formed, namely, in the nip region. Therefore, with respect to the length of the recording sheet delivered by one rotation of the soft roller, the amount of transportation becomes larger than the actual roll circumferential length corresponding to the amount of distortion in the circumferential direction. In this case, the proportion of the amount of transportation increased from the actual roll circumferential length is expressed as $\epsilon(\%)$, which is defined as an amount of distortion. Namely, $$\epsilon(\%)=[(A\div B)-1]\times 100$$

where A represents the length of a recording sheet transported per one rotation of the roll and B represents a roll circumferential length if there is no distortion, respectively.

In the present invention, the amount of distortion formed in the fixing roller 10 by the pressure pad 12 is, preferably, within a range from 0.1 to 4% and, more preferably, 0.1 to 3% and, particularly preferably, within a range from 0.5 to 2%. If the amount of distortion is smaller than 0.1%, the releasability is not sufficient. On the other hand, if it exceeds 4%, creasing is caused to the releasing layer 10*c* of the fixing roller 10, which is not preferred.

Further, since the pressure pad 12 is disposed in a fixed state not rotated as the roll, heat conducted from the fixing roller 10 is less dissipated and even when the fixing roller 10 starts rotation and the endless belt 11 is driven rotationally, the amount of heat deprived from the fixing roller 10 is small because the endless belt 11 is a thin film and has a small heat capacity. Since the fixing device according to this embodiment causes less heat loss as described above, the temperature of the fixing roller is less lowered to provide an economical advantage.

Since the belt running guide 13 is in sliding contact with the inner surface of the endless belt 11, it is desirably formed with a material of low friction coefficient and preferably made of a material of low heat conductivity so as to deprive the belt of less heat. Heat resistant resin such as PFA or PPS can be mentioned for such material.

As has been described above, the fixing device according to the first embodiment of the present invention can provide high releasability without using a releasing agent (oil). Oil may of course be used for obtaining higher releasability.

However, in a full color copying machine, a great amount of toner is transferred on a recording sheet and greater stripping force is required upon stripping at the exit of the nip area, since the toner of four colors, namely, yellow, magenta, cyan and black is used. If the recording sheet has relatively high rigidity such as J paper manufactured by Fuji Xerox Co., Ltd. (unit weight: 80 g/m$^2$), self stripping is possible by the rigidity of the paper. However, if the amount of the toner is large or in a case of using a recording sheet of weak rigidity such as S paper manufactured by Fuji Xerox Co., Ltd. (unit weight: 56 g/m$^2$) or tracing paper, stripping becomes difficult and the recording sheet may possibly be wound around the fixing roller 10. In such a case, if a plurality of stripping fingers which are often employed in existent black and white fixing devices are used, since localized force is exerted, toner image is injured by the stripping fingers to possibly cause image defects. Further, the surface of the fixing roller 10 is locally damaged by the long time use, to possibly shorten the working life of the fixing roller 10.

In view of the foregoing problems in the prior art, it is desirable to provide a stripping unit 18 as an aid for stripping the recording sheet in the fixing device according to the first embodiment of the present invention. The stripping unit 18 is situated at the downstream of the nip area in the rotational direction (in the direction of an arrow B) of the fixing roller 10 and the releasing sheet 18 a is held by the guide 18B in a state in contact with the fixing roller 10 in a direction opposite to the rotational direction of the fixing roller 10 (reverse direction). The "contact" mentioned herein includes a state in which only the top end of the releasing sheet 18*a* is brought into contact, as well as a state in which the top end and the vicinity of the top end are in a face-to-face contact or in a state where only the vicinity of the top end is in a face-to-face contact with the top end being raised in a microscopic view.

For the releasing sheet 18*a,* a heat resistant plastic sheet, for example, made of polyimide resin, polyamide resin or polyamideimide resin, or a thin metal plate such as iron or stainless steel can be used. The thickness of the releasing sheet 18*a,* while depending on the material used, is preferably about from 50 to 150 μm, for example, in a case of using the polyimide resin. If it is less than 50 μm, there is a worry that no press contact force can be provided for ensuring the stripping force, whereas if it exceeds 150 μm, the recording sheet to be released abuts against the top end of the releasing sheet 18*a* possibly failing to smooth stripping, which is not preferred. Further, the releasing sheet 18*a* may be covered at the surface with a fluoro resin such as PFA film. Covering with the fluoro resin can extend the working life of the releasing sheet 18*a* due to the hardness of the fluoro resin.

The releasing sheet 18*a* has a width of contact substantially equal with the axial length of the fixing roller 10. Such a releasing sheet 18*a* of large width supports the recording sheet over the entire width of the releasing sheet 18*a,* so that a pressure exerting per unit area on the recording sheet is reduced and does not injure the toner image. Accordingly, even if the releasing sheet 18*a* rubs the surface of the molten toner image just after fixing, it does not injure the images. "Substantially equal with the axial length of the fixing roller 10" mentioned in this text means such a length as capable of obtaining the effect described above and it actually contains a length as far as about one-half of the axial length of the fixing roller 10. However, it is preferred that the releasing sheet 18*a* has a width over the entire paper passing width of the recording sheet in order to eliminate the difference in the state of image between the contact portion and the non-contact portion of the releasing sheet 18*a,* thereby eliminating unevenness in the fixing caused by the difference in the state of degradation between the contact portion and non-contact portion of the releasing sheet 18*a* in the fixing roller 10 and to attain the foregoing effect at a high level.

It is necessary that the releasing sheet 18*a* is in press contact with the fixing roller 10 at such force as eliminating undulation at the top end and/or near the top end of the releasing sheet 18*a* caused by heating upon press contact with the fixing roller 10. The press-contact force, while different depending on the material used, is about 100 to 500 g, for example, in a case of using a polyimide resin of 300 mm in width.

The releasing sheet 18*a* is attached in a state protruded by a certain length from the top end of the guide 18*b*. Rigidity capable of withstanding the toner stripping force for the toner is ensured irrespective of the reduced film thickness by making the protruding length relatively shorter. A preferred protruding length, while different depending on the material to be used, is about 2 to 5 mm, for example, in a case of using the polyimide resin.

An angle formed between a tangential line at a point of the releasing sheet 18*a* in contact with the fixing roller 10 and the releasing sheet 18*a* is, preferably, about 20 to 50° and, more preferably, about 30 to 40°. If the angle exceeds 50°, it is difficult to ensure the press contact force described above, whereas if it is less than 20°, the recording sheet abuts against the lateral side of the releasing sheet 18*a* upon stripping thereby resulting in a worry that smooth stripping is not possible anymore, which is not preferred.

The guide 18*b* holds the releasing sheet 18*a* and is secured to a frame of the fixing device. Therefore, the guide 18*b* is required to have a certain rigidity, and various metals or plastics can be used therefor.

(Second Embodiment of Fixing Device)

Figure 2:
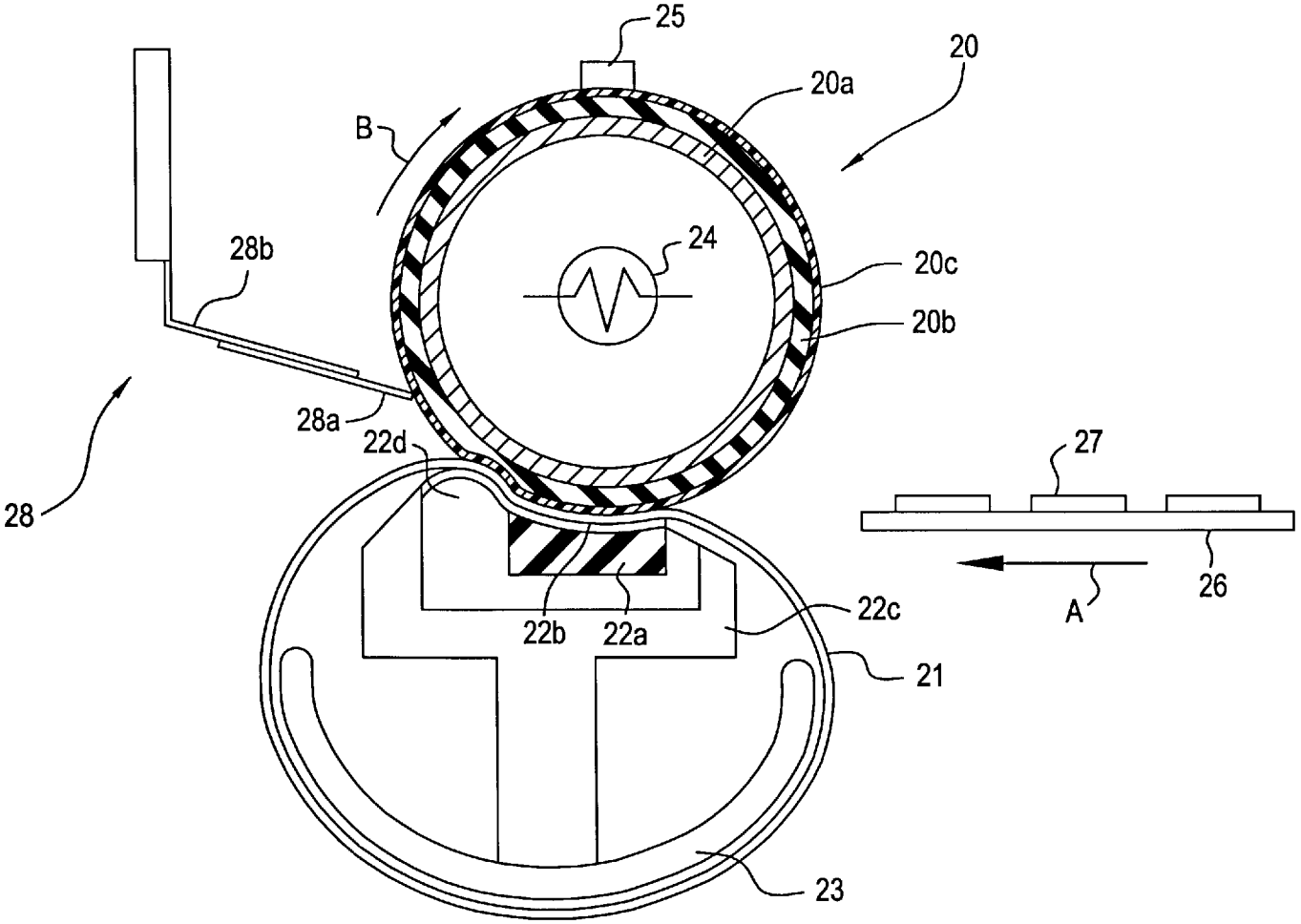
FIG. 2 is a side cross sectional view illustrating a second embodiment of a fixing device according to the present invention.

FIG. 2 is a side cross sectional view illustrating a second embodiment of a fixing device according to the present invention. The constitution of a fixing roller 20, an endless belt 21 and a stripping unit 28 are identical with those of the fixing device of the first embodiment. However, the constitution of a pressure pad (pressure member) 22 is different in this embodiment.

As a basic constitution of a pressure pad 22 in this embodiment, a pre-nip member 22*a* for ensuring a large width nip area is disposed at the inlet of the nip area, and a releasing nip member 22*d* for providing the fixing roller 20 with distortion is disposed at the exit of the nip area, respectively. Further, for lowering the sliding resistance between the inner circumferential surface of the endless belt 21 and the pressure pad 22, a low friction layer 22*b* is disposed to the surface of the pre-nip member 22*a* and the releasing nip member 22*d* in contact with the endless belt 22. The pre-nip member 22*a* is made of the same material and has the same shape as those of the elastic member 12*a* in the first embodiment. Further, the low friction layer 22*b* is made of the same material and has the same shape as those of the low friction layer 12*b* in the first embodiment.

In this embodiment, a nip area of a larger width is ensured by the pre-nip member 22*a* in a concave shape substantially conforming with the outer circumferential surface of the fixing roller 20, and the distortion of the fixing roller 20 is increased locally near the exit of the nip area (hereinafter sometimes referred to as "releasing nip area") by the releasing nip member 22*d* protruded relative to the outer circumferential surface shape of the fixing roller 20. By locally increasing the distortion of the fixing roller, high releasing performance can be obtained with a smaller amount of distortion, compared with the case of causing distortion over the entire nip region as in the fixing system using a roll pair. Accordingly, occurrence of creasing can be prevented even in a case of using a thin film heat resistant resin layer, a problem such as stripping between the heat resistant elastic layer and the releasing layer made of heat resistant resin is less likely to occur thereby enabling to obtain reliability for long time, as well as keep the releasability.

In addition, since the amount of distortion for the fixing roller 20 may be smaller, the thickness of the heat resistant elastic layer of the fixing roller 20 can be reduced. Since this contributes to the decrease of the heat capacity of the fixing roller 20, instant starting performance is further improved and electric power consumption can also be reduced. Further, since the thickness of the heat resistant elastic layer of poor heat conductivity can be reduced, the heat resistance between the inner surface and the outer surface of the fixing roller can be made smaller to promote the heat response. Accordingly, fixing at higher speed is possible.

There is no particular restriction on the material of the releasing nip member 22*d,* for which materials less deformable are preferred. For example, heat resistant resin such as PPS, polyimide, polyester or polyamide, or metal such as iron, aluminum or stainless steel can be used. The shape of the releasing nip member 22*d* is preferably such that the outer surface shape at the nip area is a protruded curved surface having a constant radius of curvature and a preferred range of radius of the curvature is about 2 to 5 mm, while it depends on the radius of the fixing roller 20, and the thickness and hardness of the heat resistant elastic layer 20*b*.

(Third Embodiment of the Fixing Device)

Figure 3:
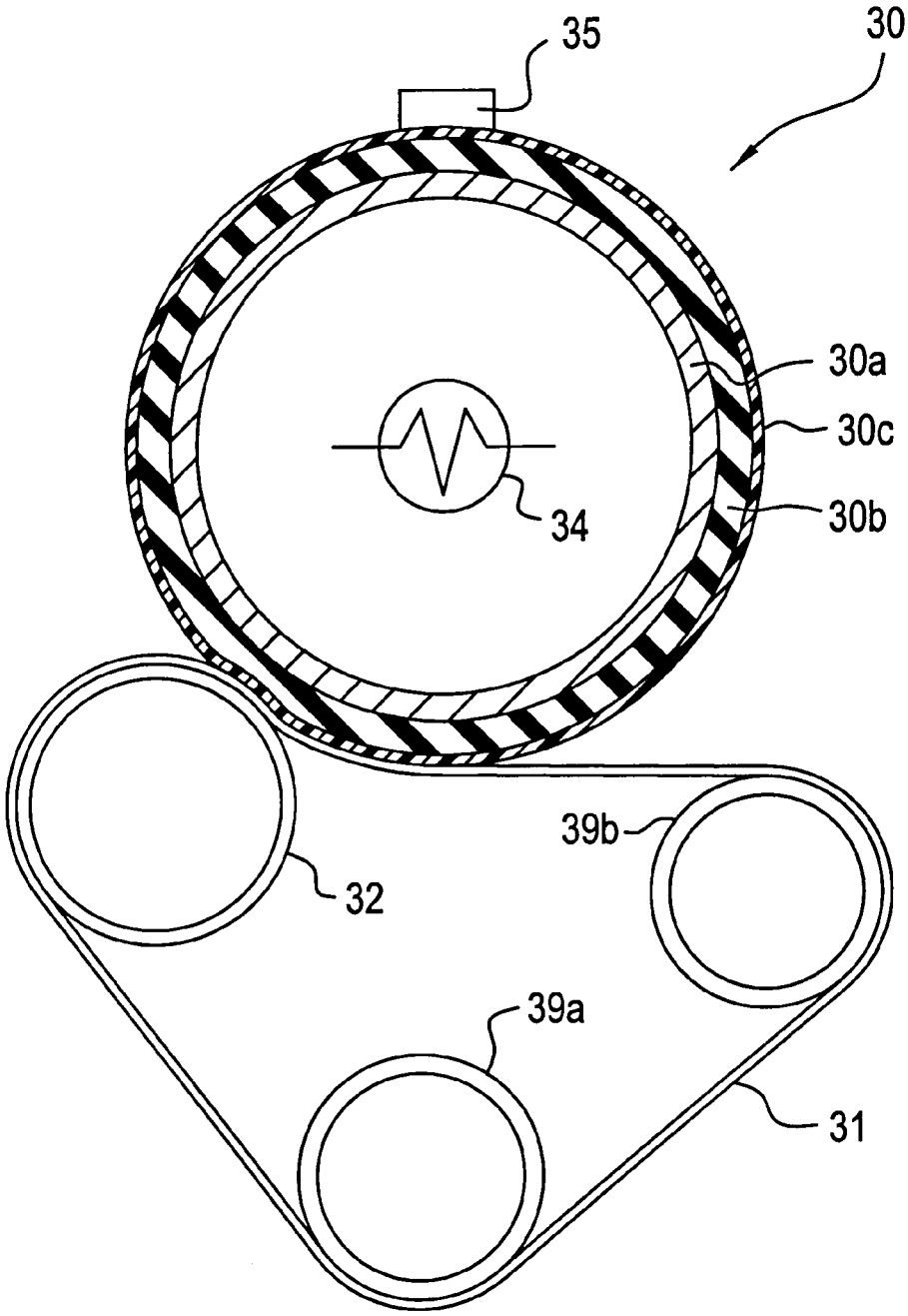
FIG. 3 is a side cross sectional view illustrating a third embodiment of a fixing device according to the present invention.

FIG. 3 is a side cross sectional view illustrating a third embodiment of a fixing device according to the present invention. The constitution of a fixing roller 30 and an endless belt 31 is identical with that of the fixing device in the first or the second embodiment. However, this embodiment is different in the constitution of the pressure member and in that an endless belt 31 is laid around three rollers, namely, a pressure roller 32, as well as tension rollers 39*a*, 39*b*. This constitution is disclosed in Japanese Patent Application Unexamined Publication No. Hei 5-150679.

The endless belt 31, like that the fixing device of the first or the second embodiment, is wound around the fixing roller 30 at a predetermined winding angle to form a nip area. However, at the exit of the nip area, the pressure roller 32 is pressed against the fixing roller 30 to provide distortion to a heat resistant elastic layer 30*b* of the fixing roller 30. With such a constitution, a nip area of a large width is ensured and the distortion of the fixing roller 30 is increased locally like the distortion in the fixing device of the second embodiment. The effects are also identical with those in the fixing device of the second embodiment. Further, in this embodiment, the amount of distortion of the fixing roller 30 near the exit of the nip area can be provided relatively largely (about 3%). Increase for the amount of the distortion enables self-stripping, so that stripping unit 18, 28 in the fixing device of the first or the second embodiment is not necessary anymore.

Figure 12:
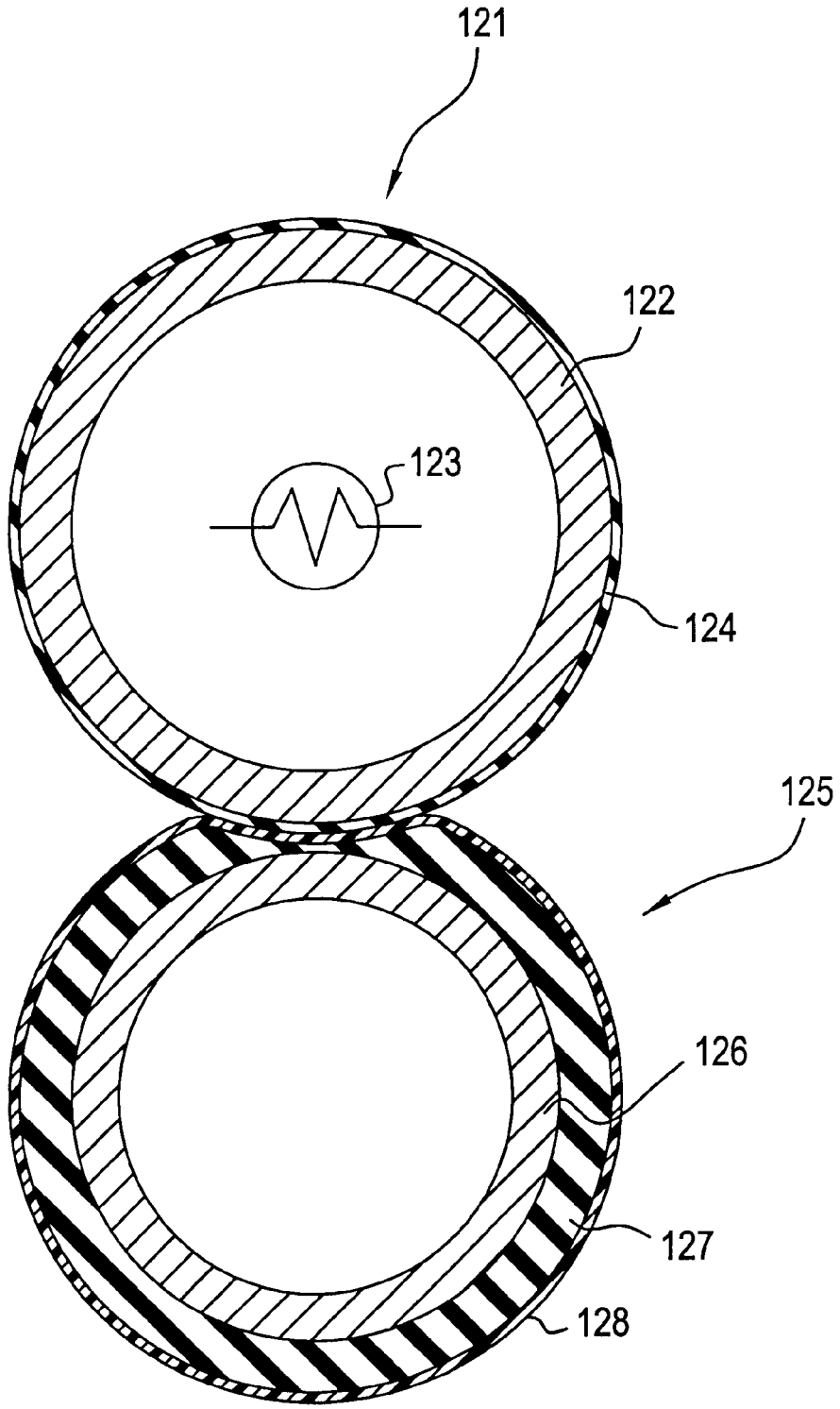
FIG. 12 is a side cross sectional view illustrating an example of a fixing device by a conventional heat fixing method.
Figure 13:
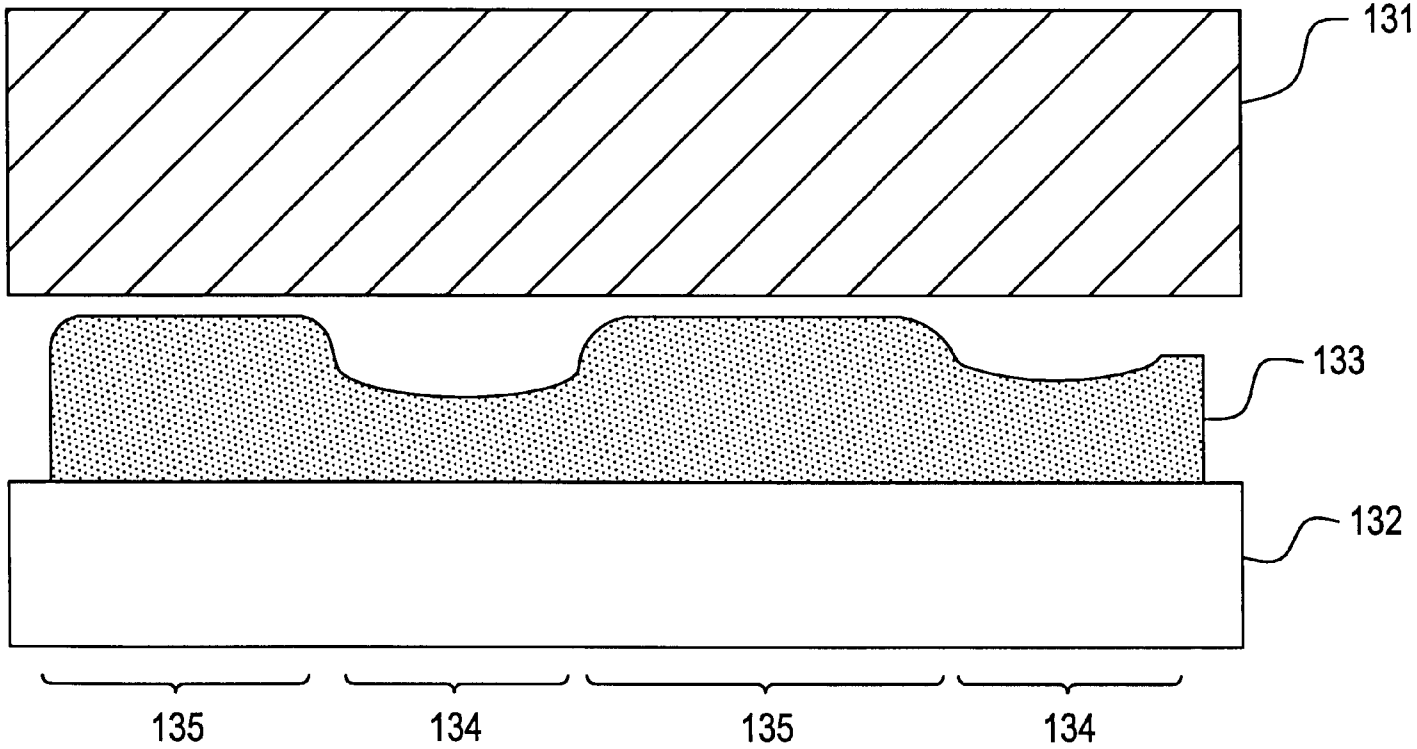
FIG. 13 is an enlarged cross sectional view schematically illustrating the state of a fixing roller, a recording sheet and a toner image during fixing.

The pressing force of the pressure roller 32 is controlled so as to provide such a range of distortion that is described as a preferred range for the fixing device of the first embodiment and, since the diameter of the pressure roller 32 can be made smaller, compared with the pressure roller in the fixing device of the existent roller pair system (refer to FIG. 12 and FIG. 14), sufficient stripping force can be obtained with smaller pressing force and a smaller amount of distortion.

B. Image Forming Apparatus

The fixing device of the constitution described above can be used in electrophotographic image forming apparatus known so far. Namely, an image forming apparatus capable of satisfying improved image quality, extended working life, energy saving and high speed fixing all together can be provided in an image forming apparatus comprising an electrostatic latent image forming unit that forms electrostatic latent images on an electrostatic latent image support, a developing unit that develops the electrostatic latent images with toner, a transfer unit that transfers the resultant toner images to a recording sheet and a fixing unit that fixes transferred toner images on a recording sheet, by using the fixing device of the above-mentioned constitution as the fixing unit.

For the other constitutions than the fixing device, any of known constitutions may be used so long as it is not contrary to the object of the present invention.

C. Toner Suitable to Use in the Present Invention

Explanations will be made to toners suitable to be used in the present invention (hereinafter simply referred to as "toner suitable to the present invention").

The toner suitable to the present invention comprises at least a colorant, a binder resin, and wax from 0.1% by weight to 40% by weight. Wax incorporated in the toner gives an effect of a releasing agent and a wider fixing latitude can be obtained also in a case of application to the fixing device according to the present invention in which a releasing oil is not used on the surface of the heat-fixing roller. Further, in the fixing device according to the present invention, the width of the nip area can be made large as described above, so that when a toner image with wax-containing toner is fixed, the wax exudes sufficiently to ensure satisfactory releasability. Accordingly, it is possible to design a full color copier or printer which is small in size and reduced in the cost with no requirement for supplying oil to the fixing device.

The fixing latitude mentioned herein means a region of temperature ranging from a low temperature at which an unfixed toner image can be fixed to a recording sheet (lowest fixing temperature) to a high temperature at which a toner image cannot be stripped anymore from the fixing roller (offset forming temperature) when the temperature of the fixing roller is changed.

Referring to the wax content in the toner, the offset forming temperature rises abruptly at about 0.1% by weight and the offset forming temperature rises moderately as the wax content increases further. On the other hand, the lowest fixing temperature rises moderately as the wax content increases. Then, if the wax content exceeds 40% by weight, the lowest fixing temperature rises extremely. Accordingly, a wide fixing latitude and a low fixing temperature can be made compatible by defining the wax content within a range from 0.1 to 40% by weight, preferably, 1 to 10% by weight.

When the wax is incorporated in the toner, there is a problem that the transparency of the image after fixing is somewhat reduced in a case of using a transparency film (OHP film) as a recording sheet (hereinafter referred to as "OHP transparency"). It has been confirmed by the study of the present inventors, et al that the OHP transparency depends on the dispersion unit of the wax in the toner. That is, if the dispersion unit of the wax in the toner is atomized to such a unit as causing less effect on the OHP transparency, the problem concerning the OHP transparency occurs no more irrespective of the size of the crystallinity of the wax. Specifically, the dispersed diameter (grain size) of the wax contained is, preferably, 2 $\mu$m or less and, more preferably, 1 $\mu$m or less on the number average basis.

The dispersed diameter of the wax can be measured as below. When the toner is set by a binder resin such as an epoxy resin, sliced to a thickness of about 1000 Å by a microtome and observed under a transmission microscope, phase-separated wax grains can be seen. In the present invention, for correcting errors caused depending on the positions of slicing the grain, measurement was conducted at 10 positions and the dispersed diameter was determined as an average for large grains at five points.

Referring to the wax, so-called low melting point wax having a melting point of 110° C. or lower and/or having a latent heat of melting of 230 mJ/mg or less acts more effectively as a releasing agent on the boundary between the fixing roller and the toner thereby making it possible to prevent high temperature offset without coating a releasing agent such as oil to the fixing roller. That is, when wax melting at a temperature sufficiently lower than that of the toner binder resin to be described later is used, the wax exudes effectively from the toner prior to the binder resin, is present at the boundary between the toner and the fixing roller upon stripping at the exit of the nip area and effectively contributes to the improvement of the releasability. If the melting point exceeds 110° C. or the latent heat upon melting exceeds 230 mJ/mg, no sufficient releasability can be attained, which is not preferred. On the contrary, if the melting point is lower than 30° C., the toner sometimes lacks in the blocking resistance and storability, which is not preferred. The melting point is defined as a maximum heat absorption peak by a differential scanning calorimeter.

There is no particular restriction on the wax usable in the present invention providing that the wax has releasability and the following materials can be mentioned, specifically.

Wax can include plant wax such as carnauba wax, cotton wax, Japan wax or rice wax, animal wax such as bee wax and lanolin, mineral wax such as ozokerite and selsyn, as well as petroleum wax such as paraffin, microcrystalline and petrolatum. In addition to the natural wax described above, there may be used synthetic hydrocarbon wax such as Fisher-Tropsch wax or polyethylene wax, and synthetic wax such as 12-hydroxystearic acid amide, stearic acid amide, phthalic acid anhydride imide, aliphatic acid amide, ester, ketone or ether of halogenated hydrocarbon. Furthermore, crystalline polymeric resins of low molecular weight can include those crystalline polymers having long alkyl groups on the side chain such as homopolymers or copolymers of polyacrylate, for example, poly n-stearyl methacrylate or poly-n-lauryl methacrylate (for example, copolymer of n-stearyl acrylate ethyl methacrylate). Among them, more preferred are petroleum wax and synthetic wax such as paraffin wax of microcrystalline wax.

There is no particular restriction on the binder resin in the toner suitable to the present invention and those resins (polymers) used ordinarily as the binder resin for the toner can be used. There can be mentioned, specifically, polyester resin, styrene resin, acrylic resin, styrene-acrylic resin, silicone resin, epoxy resin, dienic resin, phenolic resin, ethylene-vinyl acetate resin, polyester resin being particularly preferred. When the polyester resin is used for the binder resin, surface flatness is high even if the molecular weight is large, and an image of excellent transparency can be formed and there is no problem in the safety of the material per se.

It is preferred that the binder resin in the toner suitable to the present invention at least partially comprises a mixture of a linear polymer having a weight average molecular weight from 2,000 to 50,000 and a non-linear polymer having a weight average molecular weight from 2,000 to 50,000. When the binder resin in the toner has the constitution as described above, the linear polymer can provide satisfactory fixing property to the recording sheet, while the non-linear polymer can provide satisfactory releasability from the heat fixing roller, respectively. The weight average molecular weight measured by GPC of the polymers is, preferably, from 2,000 to 50,000 and, more preferably, 8,000 to 20,000 with a view point of the transparency and the storage stability.

"Linear polymer" mentioned herein means those having no cross-linked structure and this concept also includes those having so-called branched structure but to such an extent that can be used as the binder resin for the toner. On the other hand, "non-linear polymer" means mainly those having cross-linked structure.

Specifically, in a case where the linear polymer and the non-linear polymer are polyester, they are obtained by blending a constituent monomer having a structure comprising a linear dicarboxylic acid and/or dicarboxylic acid having non-functional side chains, with a non-linear polyester subjected to three-dimensional crosslinking having tri- or higher valent monomer, other crosslinking agents and the like in the constituent monomer.

As preferred polymerization monomers for the polyester, the followings can be mentioned.

Alcoholic components can include, diols such as polyoxypropylene(2,2)-2,2-bis(4-hydroxyphenyl)propane, polyoxypropylene(3,3)-2,2-bis(4-hydroxyphenyl)propane, polyoxyethylene(2,0)-2,2-bis(4-hydroxyphenyl)propane, polyoxypropylene(2,0)-polyoxyethylene(2,0)-2,2-bis(4-hydroxphenyl) propane, ethylene glycol, diethylene glycol, triethylene glycol, polyethylene glycol, propylene glycol, dipropylene glycol, isopentyl glycol, dipropylene glycol, hydrogenated bisphenol A, 1,3-butanediol, 1,4-butanediol, neopentyl glycol, xylylene glycol, 1,4-cyclohexane dimethanol, glycerin, trimethylol ethane, trimethylol propane, pentaerythritol, bis-(β-hydroxyethyl) terephthalate, tris-(β-hydroxyethyl)isocyanurate, and 2,2,4-trimethyrol pentane-1,3-diol.

On the other hand, acid components can specifically include, for example, malonic acid, succinic acid, glutaric acid, dimeric acid, phthalic acid, isophthalic acid, terephthalic acid, dimethyl isophthalate, dimethyl terephthalate, monomethyl phthalate, tetrahydroterephthalic acid, methyl tetrahydrophthalic acid, hexahydrophthalic acid, dimethyl tetrahydrophthalic acid, endomethylene hexahydrophthalic acid, naphthalene tetracarboxylic acid, diphenolic acid, trimellitic acid, pyromellitic acid, trimesic acid, cyclopentane dicarboxylic acid, 3,3',4,4'-benzophenone tetracarboxylic acid, 1,2,3,4-butane tetracarboxylic acid, 2,2-bis-(4-carboxyphenyl)propane, diimide carboxylic acid obtained from trimellitic acid anhydride and 4,4-diaminophenyl methane, tris-(β-carboxyethyl)isocyanurate, isocyanurate ring-containing polyimide carboxylic acid, and isocyanate ring-containing polyimide carboxylic acid obtained from trimerizing reactant of tolylene diisocyanate, xylylene diisocyanate or isophorone diisocyanate and trimellitic acid anhydride, and one or more of them may be used.

Among them, if crosslinking components such as tri-or higher valent carboxylic acid or polyhydric alcohol is used, a preferred cross-linked polyester in view of the stability such as fixing strength or offset resistance can be obtained. Specifically, there can be mentioned tri-basic carboxylic acid such as trimellitic acid anhydride and 2,5,7-naphthalene tricarboxylic acid or derivatives thereof and trihydric alcohol such as glycerol and trimethyrolpropane. Further, combined use of a monomer having side chains of 2 to 30 carbon atoms such as dodecenyl succinic acid is preferred since the softening point can be controlled as described below.

Generally, while the cross-linked type non-linear polymer has excellent anti-hot offset property in a high temperature region, if the crosslinking density is increased excessively by using tri- or higher valent monomers as the crosslinking component, the elasticity of the polymer is increased and the melting rate is lowered, so that smoothness and gloss on the fixing surface are deteriorated. However, such disadvantages can be avoided by controlling the blending ratio, the glass transition point (Tg) and the softening point of the resin upon blending the linear polymer and the non-linear polymer.

More specifically, the mixing ratio of the linear polymer and the non-linear polymer (linear polymer:non-linear polymer weight ratio) is, preferably, within a range from 40:60 to 90:1 and, more preferably, within a range from 60:40 to 90:10. If the ratio of the linear polymer is less than 40%, the lowest fixing temperature rises, as well as the color forming property or OHP transparency are reduced. On the other hand, if the ratio exceeds 99%, no sufficient offset resistance can be obtained easily.

Further, Tg for the linear polymer is, preferably, from 40 to 80° C. and, more preferably, from 50° C. to 70° C. If Tg is lower than 40° C., toner storability was worsened. On the other hand, if it exceeds 80° C., the lowest fixing temperature rises or the processability of the toner particles may also be worsened. Further, since the difference of Tg between the linear polymer and the non-linear polymer also gives an effect on the toner characteristics such as gloss, the difference of Tg between both of them is, suitably, less than 20° C. and, more desirably, less than 10° C.

Furthermore, the softening point of the linear polymer is preferably from 90 to 120° C. If the softening point is lower than 90° C., the store stability of the toner is poor and the toner may sometimes cause blocking in a stored state under high temperature and high humidity conditions (for example at 45° C., about 80 RH). If the softening point exceeds 120° C., the lowest fixing temperature of the toner rises, as well as the color forming property and OHP transparency are poor to provide dull color and the processability of the toner particles may also be worsened. Further, since the difference of the softening point between the linear polymer and the non-linear polymer also gives an undesired effect on the gloss, the difference of the softening point between them is, optimally, 20° C. or less or, desirably, 10° C. or less.

The softening point mentioned herein is determined as described below. A specimen of 1 $cm^3$ is extruded out of a nozzle having a 1-mm diameter and 1-mm length while giving a load of 30 $kg/cm^2$ by a plunger, under heating at a temperature elevation rate of 6° C./min, by using a depression (KOKA type) flow tester (manufactured by Shimadzu Corp.), a curve is drawn based thereon for the relation of the plunger depression amount-temperature, and a temperature corresponding to h/2 (h being the height of an S-shaped curve), that is a temperature at which one-half of the resin is flown out, is defined as the softening point.

As the binder resin for the toner suitable to the present invention, use of a mixture of a polyester resin and a cross-linked polyester resin as described above is preferred, which may be further combined with other resins. Other resins can include, for example, styrenic resin, acrylic resin, styrene-acrylic resin, silicone resin, epoxy resin, dienic resin, phenolic resin, terpene resin, coumarin resin, amide resin, amidimide resin, butyral resin, urethanic resin, and ethylene-vinyl acetate resin.

When other resin is combined, the ratio of the linear polymer and the non-linear polymer in the entire binder resin is, preferably, 30% by weight or more and, more preferably, 50% by weight or more.

The glass transition temperature is set, preferably, to 40° C. to 80° C. and, more preferably, 50° C. to 70° C. Further, since the difference of the glass transition temperature between the linear polyester and the non-linear polyester also gives undesired effects on the toner characteristics, the difference of the glass transition temperature between them is optimally defined as 20° C. or lower, desirably, 10° C. or lower. If the glass transition temperature is lower than 40° C., the toner storability is worsened. On the other hand, if the glass transition temperature exceeds 80° C., the lowest fixing temperature rises or the processability of the toner particles may possibly be worsened.

As the colorant dispersed in the toner, known organic or inorganic pigments, dyes and oil soluble dyes can be used. There can be mentioned, for example, C.I. pigment red 48:1, C.I. pigment red 57:1, C.I. pigment red 122, C.I. pigment yellow 17, C.I. pigment yellow 97, C.I. pigment yellow 12, C.I. pigment yellow 180, C.I. pigment yellow 185, C.I. pigment blue 15:1, C.I. pigment blue 15:3, lump black (C.I. No. 77266), rose bengal (C.I. No. 45432), carbon black, Nigrosine dye (C.I. No. 50415B), metal complex dye, derivative of metal complex dye or mixture thereof. Further, various metal oxides can be mentioned, including, for example, silica, aluminum oxide, magnetite or various kinds of ferrite, cupric oxide, nickel oxide, zinc oxide, zirconium oxide, titanium oxide and magnesium oxide and their appropriate mixtures. It is necessary that the colorant is contained at such a ratio to form a visible image at a sufficient density, and an appropriate ratio is generally about from 1 to 100 parts by weight based on 100 parts by weight of the toner while depending on the grain size of the toner and the amount of development.

The toner suitable to the present invention can be prepared by any known method. For example, toners usable herein can be prepared by a method of kneading-pulverization system, namely, a method of mixing a binder resin, a colorant, wax and the like preliminarily, then melt-kneading the mixture in a kneader, cooling and then pulverizing and classifying the same and then admixing fine particles of external additives, or polymer toners obtained, for example, by suspension polymerization or emulsion polymerization can be used.

Further, as the method of controlling the dispersed diameter of the wax contained in the toner, a method of dispersing previously particulated wax into the toner is preferred. As a method of itomizing the wax in advance, a method of heating the wax together with a solvent, then cooling and itomizing the same can be mentioned specifically. They are taken out as a powder and mixed with other components of the toner as described above. Alternatively, toner can be prepared by dissolving other components of the toner in the liquid dispersion of the itomized wax.

The volume average grain size of the toner particles is preferably within a range from 3 to 15 $\mu$m and more preferably, within a range from 5 to 7 $\mu$m.

The toner is used as a two-component developer in admixture with a carrier. There is no particular restriction on the carrier usable herein and they can include, for example, magnetic particles such as of iron powder or ferrite, coating resin type carrier particles comprising magnetic particles as a core material and a coating layer formed on the surface thereof by coating a known resin such as styrenic resin, vinylic resin, ethyl type resin, rosin resin, polyester resin or methyl resin, or wax such as stearic acid, or magnetic particle-dispersed type carrier particles formed by dispersing fine magnetic particles in a binder resin.

In the present invention, a mixing ratio of the carrier and the toner is, preferably, within a range of carrier: toner= 100:1 to 100:20 (weight ratio) and, more preferably, 100:5 to 100:15 (weight ratio).

EXAMPLE

Examples of the present invention will be explained. In the examples, "part" means "part by weight" unless otherwise specified.

Example 1

<Specifications for a Fixing Device>

In Example (1-1), a fixing device shown in FIG. 2 was used. Specifications for the fixing device are as below.

Core 20*a*: cylinder made of iron (STKM11) having a 24.8-mm outer diameter and a 24-mm inner diameter Heat resistant elastic layer 20*b*: HTV (High Temperature Vulcanization) silicone rubber having a 600-$\mu$m thickness and 40° of rubber hardness (JIS-A).

Releasing layer (heat resistant resin layer) 20*c*: PFA (perfluoroalkyl vinyl ether copolymer resin) tube having a 20-$\mu$m thickness Output of halogen lamp 24: 800 W Temperature set to the surface of fixing roller 20: 150° C.

Endless belt 21: polyimide seamless belt of 75 $\mu$m in thickness and 94 mm in circumferential length as a base layer, coated with PFA 10 $\mu$m in thickness as a releasing layer.

Pre-nip member 22*a*: silicone rubber having a 6-mm width and 20° hardness (JIS-A), having a concave shape (R 26 mm) conforming with the outer circumferential surface of the fixing roller 20.

Low friction layer 22*b*: glass fiber sheet impregnated with Teflon (FGF-500-4, manufactured by CHUKO CHEMICALS INDUSTRIES LTD.)

Releasing nip member 22*d*: made of PPS, having a 3-mm radius of curvature at a pressing portion.

Figure 4:
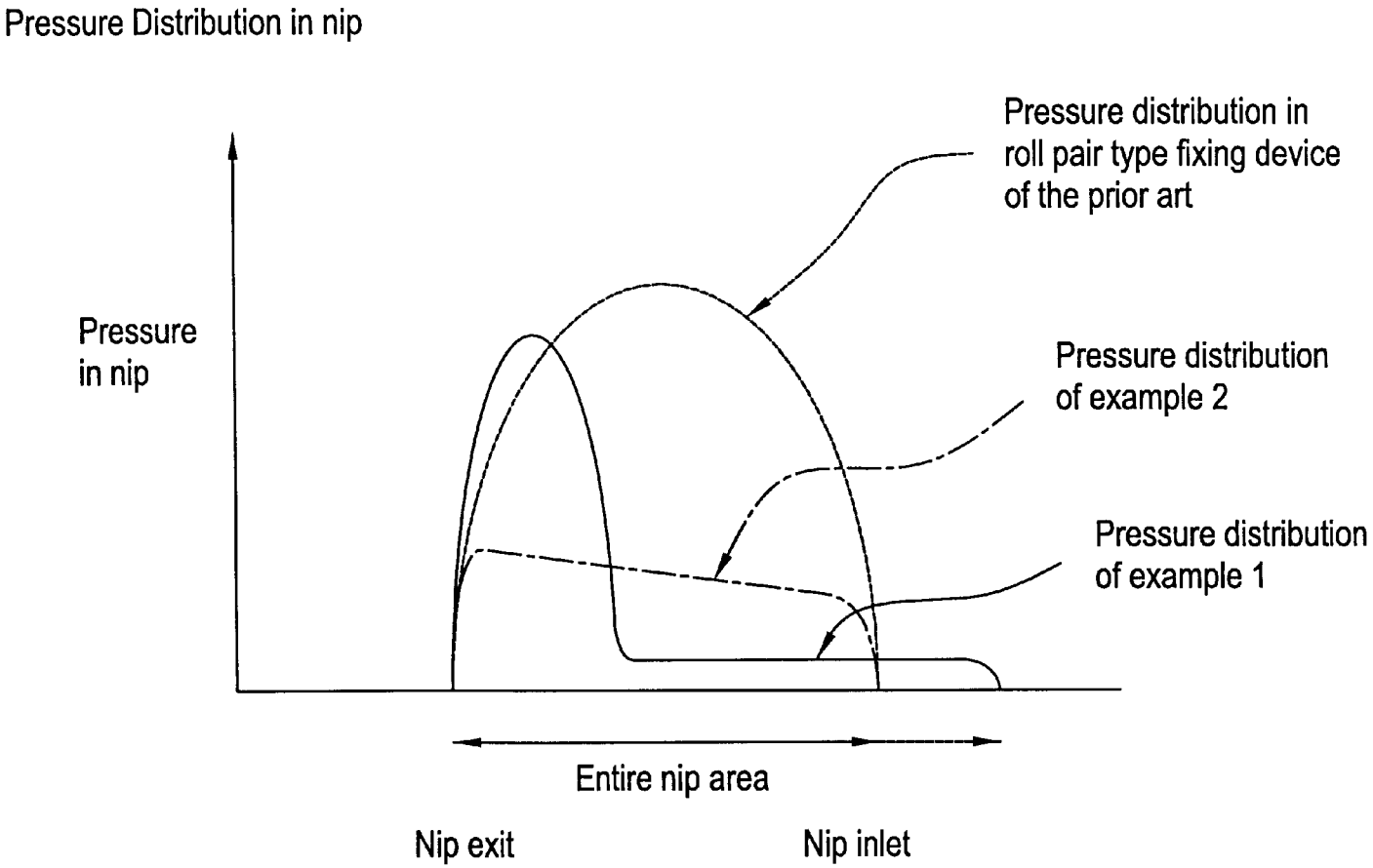
FIG. 4 is a graph showing pressure distribution in a nip area of fixing devices of examples according to the present invention and a comparative example of the prior art.

Belt running guide 13: made of PFA
Pressing force of a pressure pad 22: 30 kg in total weight.
Nip width: 6 mm
Pressure distribution in the nip width: pressure distribution as shown in FIG. 4 in which pressure in the pre-nip is area of about 0.5 kg/cm$^2$ and peak pressure at releasing nip is about 70 g/cm$^2$.
Distortion of the fixing roller 20: about 1%
Releasing sheet 28*a*: a polyimide resin sheet having a 300-mm width and a 75-$\mu$m thickness coated at the upper surface and the lower surface with a PFF film of 10 $\mu$m in thickness.
Protrusion of the releasing sheet 28*a* from the top end of the guide 28*b*: 5 mm
Circumferential speed of the fixing roller: 100 mm/sec
Dwell time in the nip area: 60 msec
<Operation of the Fixing Device>

A toner image 27 was transferred on a recording sheet 26 by a transfer device of an image forming apparatus to be described later, the recording sheet 26 was conveyed from the right in FIG. 2 to the nip area, and the toner image 27 was fixed on the recording sheet 26 by pressure effected in the nip area as well as heat generated from the halogen lamp 24 and applied through the fixing roller 20.

When an electric power of 800 W was applied to the halogen lamp 24, a time required for rising the temperature of the fixing roller 20 from the room temperature (20° C.) to 150° C. was about 15 seconds. On the other hand, for forming an unfixed full color toner image, it takes 15 to 18 seconds in a usual four-cycle apparatus. Image formation could be started from the state at a room temperature of the fixing device with no substantial stand-by time and it was confirmed that the fixing device of this Example 1-1 was excellent in the instant starting performance.

Figure 5:
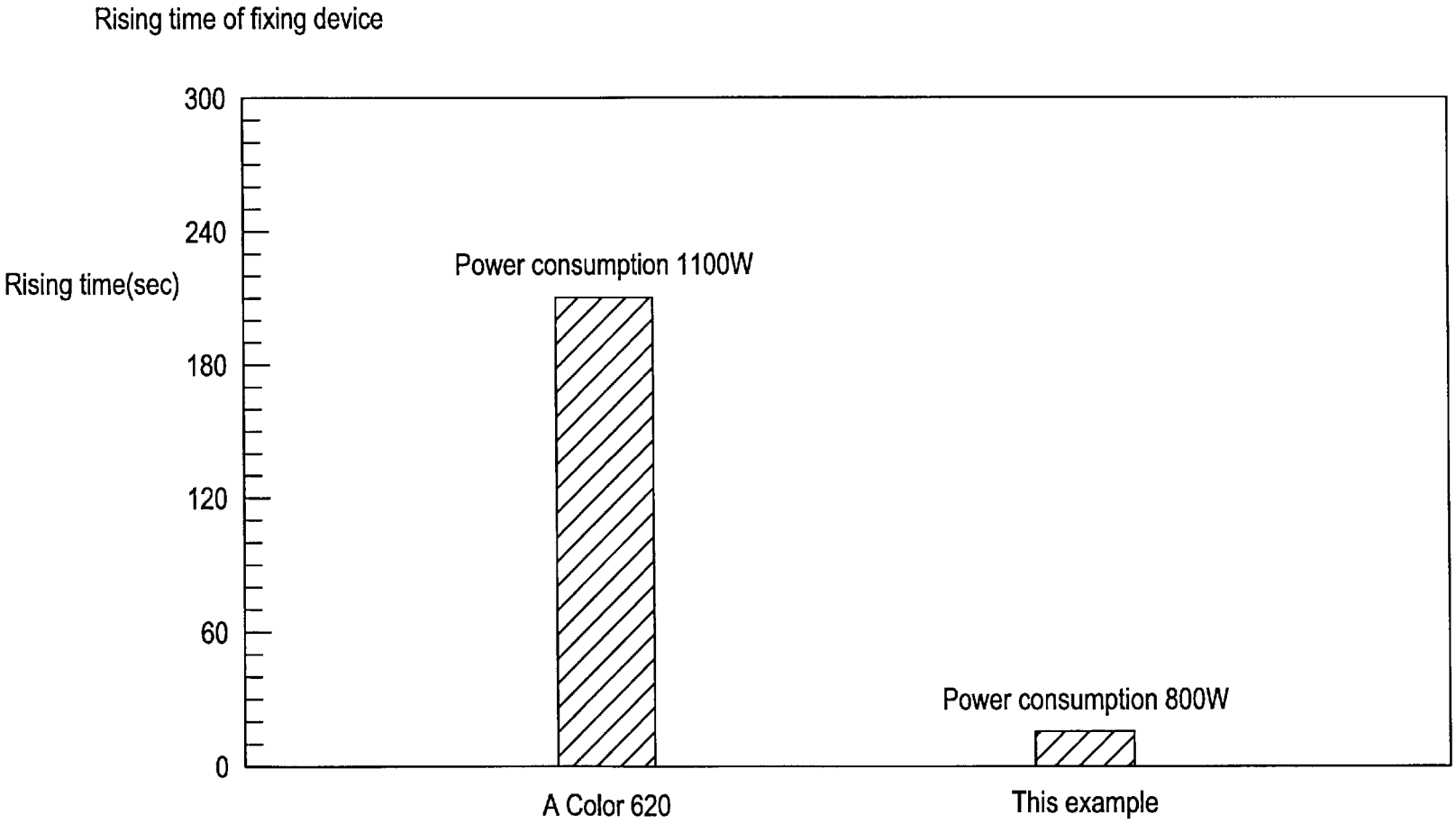
FIG. 5 is a graph showing rising time in a fixing device of an example according to the present invention and a fixing device of A Color 620 of the prior art in comparison.
Figure 14:
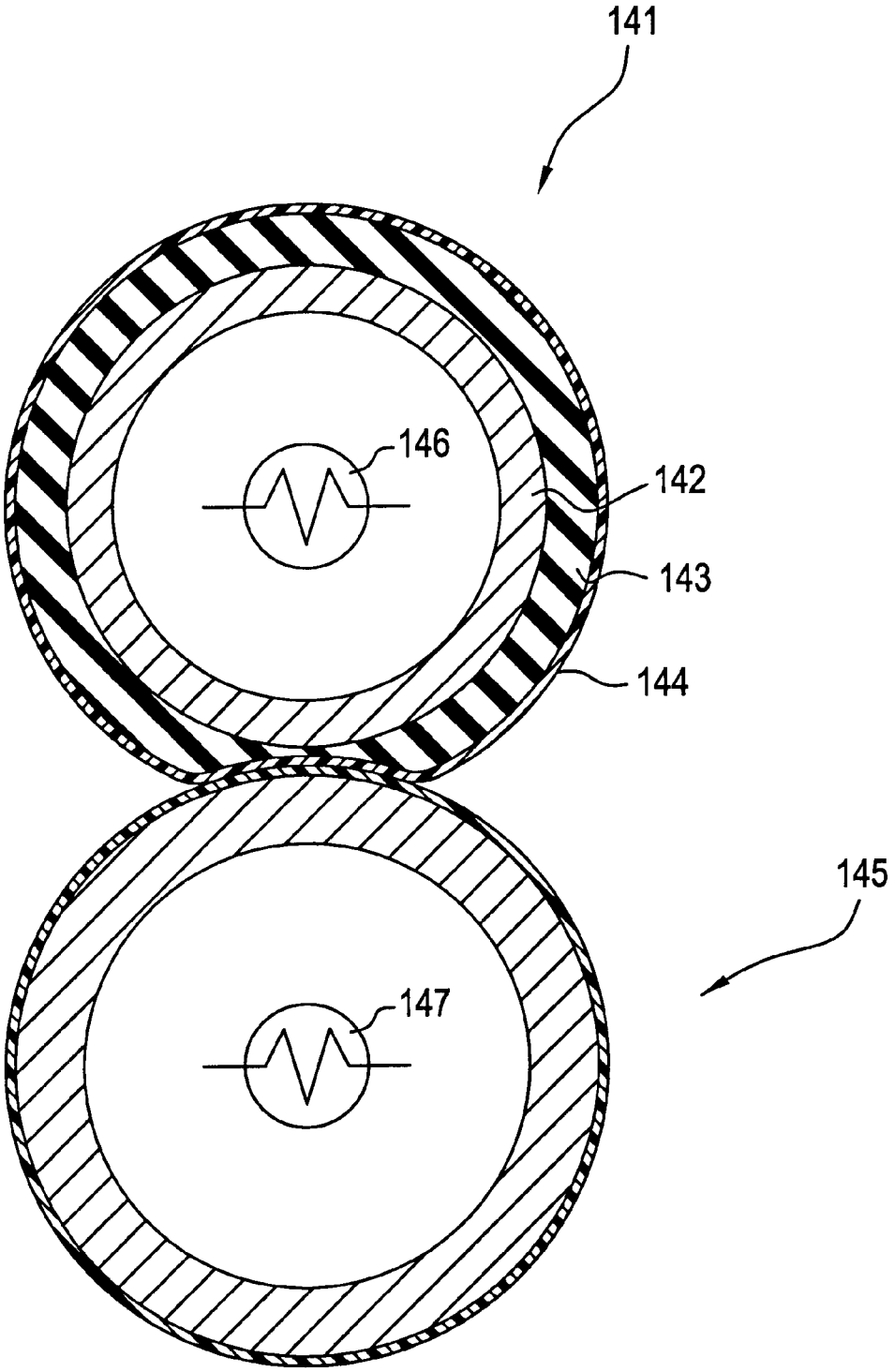
FIG. 14 is a side cross sectional view illustrating an example of a fixing device by a conventional heat-fixing method.

On the other hand, a fixing device of a full Color copier A 620 manufactured by Fuji Xerox Corp was used. Since the fixing device is a roll pair system as shown in FIG. 14, the heat capacity is large. Both the fixing roller and the pressure roller have halogen lamp, and the rising time upon charging 1100 W of electric power in total is about three minutes and 30 seconds. FIG. 5 is a graph comparing the rising time of the fixing device according to Example 1-1 and the fixing device of A Color 610 and the difference of the instant starting performance was distinct.

<Preparation of Toner Used>

In Example 1-1, the following toner was used.

[1] Preparation of a binder resin

A polyester resin A (linear polyester) and a polyester resin B (non-linear polyester) were prepared by the following procedures:

a: Preparation of polyester resin A (linear polyester)

| | |
|---|---|
| Polyoxypropylene(2,2)-2,2-bis(4-hydroxyphenyl) propane | 1050 parts |
| Fumaric acid | 520 parts |
| Hydroquinone (polymerization inhibitor) | 1 part |

The materials described above were charged together with an esterifying catalyst (dibutyl tin oxide) into a three-liter four-necked flask made of glass, to which a stainless stirring rod, descending type condenser and a nitrogen introduction tube were attached and reaction was proceeded in an electrically heated mantle heater, under a nitrogen gas stream, at 230° C., under a normal pressure in the former-half period and at 200° C. under a reduced pressure in the latter-half period while stirring. The resultant linear polyester had an acid value of 12.6 KOH mg/g, a hydroxy value of 8.9 KOH mg/g, glass transition temperature at 66° C., and a weight average molecular weight measured by GPC of 20,000.

b: Preparation of polyester resin B (non-linear polyester)

| | |
|---|---|
| Polyoxypropylene(2,2)-2,2-bis(4-hydroxyphenyl) propane | 460 parts |
| Polyoxyethylene(2,2)-2,2-bis(4-hydroxyphenyl) propane | 425 parts |
| Trimellitic acid anhydride | 48 parts |
| Dimethyl terephthalic acid | 50 parts |
| Dodecenyl succinic acid anhydride | 270 parts |
| Dibutyl tin oxide | 1 part |

Using the materials described above, the reaction was proceeded in the same manner as for the preparation of the polyester resin A (linear polyester). The resultant non-linear polyester had an acid value of 10.8 KOH mg/g, hydroxy value of 28.4 KOH mg/g, glass transition temperature at 62° C., and a weight average molecular weight measured by GPC of 95,000.

A list for the composition and the physical property of the polyester resin A (linear polyester) and the polyester resin B (non-linear polyester) obtained as described above are shown in the following Table 1.

TABLE 1

Composition - Physical Property of Polyester Resin

| | Polyester resin A | Polyester resin B |
|---|---|---|
| Polymer shape | Linear | Non-linear |
| Polyoxypropylene (2,2)-2,2-bis(4-hydroxyphenyl) propane | 1050 parts | 460 parts |
| Polyoxyethylene (2,2)-2,2-bis(4-hydroxyphenyl) propane | | 425 parts |
| Fumaric acid | 520 parts | |
| Dimethyl terephthalic acid | | 50 parts |
| Trimellitic acid anhydride | | 48 parts |
| Dodecenyl succinic acid anhydride | | 270 parts |
| Dibutyl tin oxide (catalyst) | 0.1 parts | 0.1 parts |
| Glass transition temperature (°C.) | 66 | 62 |
| Acid value (KOH mg/g) | 12.6 | 10.8 |
| Hydroxy value | 8.9 | 28.4 |
| Weight average molecular weight | 20000 | 95000 |
| Softening temperature (°C.) | 101 | 114 |

[2] Preparation of Pigment Liquid Dispersion

A pigment liquid dispersion was prepared by the following procedures:

| | |
|---|---|
| Copper phthalocyanine pigment (C.I. Pigment blue 15:3, Cyanine blue 4933M, manufactured by Dainichiseika Colour & Chemicals Mfg. Co., Ltd.) | 98 parts |
| Pigment dispersant (Solsperse 24000, manufactured by ZENECA K.K.) | 2 parts |
| Ethyl acetate | 100 parts |

Glass beads were added to the liquid dispersion of the material composition, and they were set to a sand mill dispersing machine. While cooling the periphery of a dispersing vessel of the dispersing machine, the liquid dispersion was dispersed by a high speed stirring mode for three hours, and then diluted with ethyl acetate to prepare a pigment liquid dispersion at a pigment concentration of 10% by weight.

[3] Preparation of a Liquid Dispersion of Itomized Wax

Liquid dispersion of itomized wax was prepared by the following procedures:

| | |
|---|---|
| Paraffin wax (melting point, 85° C., latent heat of melting, 198 mJ/mg) | 15 parts |
| Toluene | 85 parts |

The materials of the composition were charged in a dispersing machine equipped with a stirring blade and having a function of circulating a heat medium to the periphery of the vessel. Temperature was gradually elevated under stirring at 83 rpm and when it was elevated to 100° C., stirring was continued for three hours while keeping the temperature at 100° C. Then, it was cooled under continuous stirring to a room temperature at a rate of about 2° C./min to deposit itomized wax. When the average grain size of the wax (dispersed diameter) was measured by a laser diffraction/scattering grain size distribution measuring apparatus LA-700 (manufactured by Horiba, Ltd.), it was about 1.02 μm.

The liquid dispersion of the wax was dispersed again at a pressure of 500 kg/cm$^2$ by using a high pressure emulsifying machine (APV GAULIN HOMOGENIZER Model 15MR). When the average grain size of the wax (dispersed diameter) was measured in the same manner as described above, it was about 0.81 μm. The liquid dispersion of the obtained itomized wax was diluted with ethyl acetate to a wax concentration of 15% by weight, and used for the preparation of the toner to be described later.

[4] Preparation of Oil Phase

An oil phase used for the preparation of the toner was prepared by the following procedures.

| | |
|---|---|
| Polyester resin A described above | 70 parts |
| Polyester resin B described above | 30 parts |
| Pigment liquid dispersion (pigment concentration: 15 wt %) described above | 50 parts |
| Liquid dispersion of the itomized wax described above (wax concentration: 15 wt %) | 33 parts |
| Ethyl acetate | 32 parts |

The materials were mixed and after confirming that the polyester resin was sufficiently dissolved, they were charged in a homomixer (ACE, manufactured by Nippon Seiki Co., Ltd.) and stirred at 15,000 rpm for two minutes to prepare a homogenous oil phase.

[5] Preparation of Aqueous Phase A

Aqueous phase A used for the preparation of the toner was prepared by the following procedures.

| | |
|---|---|
| Calcium carbonate (average grain size: 0.03 μm) | 60 parts |
| Purified water | 40 parts |

The materials were stirred in a ball mill for four days, to prepare an aqueous phase A. When the average grain size of calcium carbonate was measured by using the laser diffraction/scattering grain size distribution measuring apparatus LA-700 (manufactured by Horiba, Ltd.) described above, it was about 0.08 μm.

[6] Preparation of Aqueous Phase B

Aqueous phase B used for the preparation of the toner was prepared by the following procedures.

| | |
|---|---|
| Carboxymethyl cellulose (CELLOGEN BSH, manufactured by Dai-ichi Kogyo Seiyaku Co., Ltd.) | 2 parts |
| Purified water | 98 parts |

The materials were mixed and carboxymethyl cellulose was dissolved to prepare an aqueous phase B.

[7] Preparation of Toner

A toner was prepared by using the oil phase, the aqueous phase A and the aqueous phase B obtained as described above by the following procedures.

| | |
|---|---|
| Oil phase described above | 60 parts |
| Aqueous phase A described above | 10 parts |
| Aqueous phase B described above | 30 parts |

The materials were charged in a colloid mill (manufactured by Nippon Seiki Co., Ltd.) and emulsified for 20 minutes at a gap distance of 1.5 mm and at 8000 rpm. Then, the obtained emulsion was charged in a rotary evaporator and the solvent was removed at a room temperature and at a reduced pressure of 30 mmHg for three hours. Subsequently, 12N hydrochloric acid was added to pH 2, and calcium carbonate was removed from the toner surface. Further, 10N sodium hydroxide was added to pH 10 and stirred continuously for one hour in a vessel of a supersonic cleaner while stirring by a stirring device. Then, centrifugation was conducted and, after cleaning by replacing the supernatant three times, it was dried and cyan toner was taken out. The volume average grain size of the toner measured by using a Coulter Counter TA-II type (manufactured by Coulter K. K.) was 7.8 μm, GCD as an index of the grain size distribution (Square root for $d_{84}/d_{16}$ as the volume average grain size) was 1.22 and the shape coefficient MLS2 was 107.

Each toner of yellow, magenta and black was prepared in the same manner as the cyan toner except for replacing the colorant with C.I. pigment blue 15:3 to C.I. pigment yellow 180, C.I. pigment red 57 or carbon black (#4000 manufactured by Mitsubishi Kasei Corp.), respectively. The physical properties of each toner are shown in the following Table 2.

TABLE 2

Physical Property of Toner of Each Color

| | Volume average grain size (μm) | GSD | Wax dispersed diameter (μm) |
|---|---|---|---|
| Cyan toner | 7.8 | 1.22 | 1.2 |
| Yellow toner | 7.8 | 1.25 | 0.8 |
| Magenta toner | 7.1 | 1.29 | 1.1 |
| Black toner | 7.0 | 1.23 | 0.9 |

<Preparation of Developer Used>

F300 (manufactured by Powdertech Co., Ltd.) was used as the carrier core, to which methyl methacrylate was coated at a ratio of 0.5% by weight based on the carrier core by a kneader to prepare a carrier.

The toner and the carrier described above were mixed at a ratio of toner: carrier=8:100 (weight ratio) and used for Example 1-1.

<Image Forming Test>

An image forming test was conducted by using the developer described above and using modified A Color 620 in which the fixing device was replaced with the foregoing device as the image forming apparatus.

The image forming test was conducted by copying a solid image of 0.65 mg/cm$^2$ to A4 size paper as the recording sheet (J paper manufactured by Fuji Xerox Co., Ltd.). As a result of the image forming test, satisfactory copying products with no uneven gloss were obtained. The releasability of the recording sheet was also satisfactory. Furthermore, it showed high instant starting performance with no substantially stand-by time.

<Confirmation of Material for the Fixing Roller Releasing Layer>

As Comparative Example 1-1, an image forming apparatus having a fixing device of the same constitution as that of Example 1-1 was provided excepting for using a fixing roller formed by dip-coating it with fluoro rubber to 30 μm in thickness instead of a fluoro resin as a releasing layer 20*c* of the fixing roller 20 in the fixing device having the constitution of Example 1-1. Amino modified silicone oil (manufactured by Shin-etsu Chemical Co., Ltd.: viscosity, 300 CS) was coated by about 5 mg per A4 size paper as a releasing agent to the fluoro rubber roller (the releasing agent is not supplied to the fixing roller in the case of this example (fluoro resin roller)). The toner used had a composition formed by removing the wax from the toner of Example 1-1.

Figure 6:
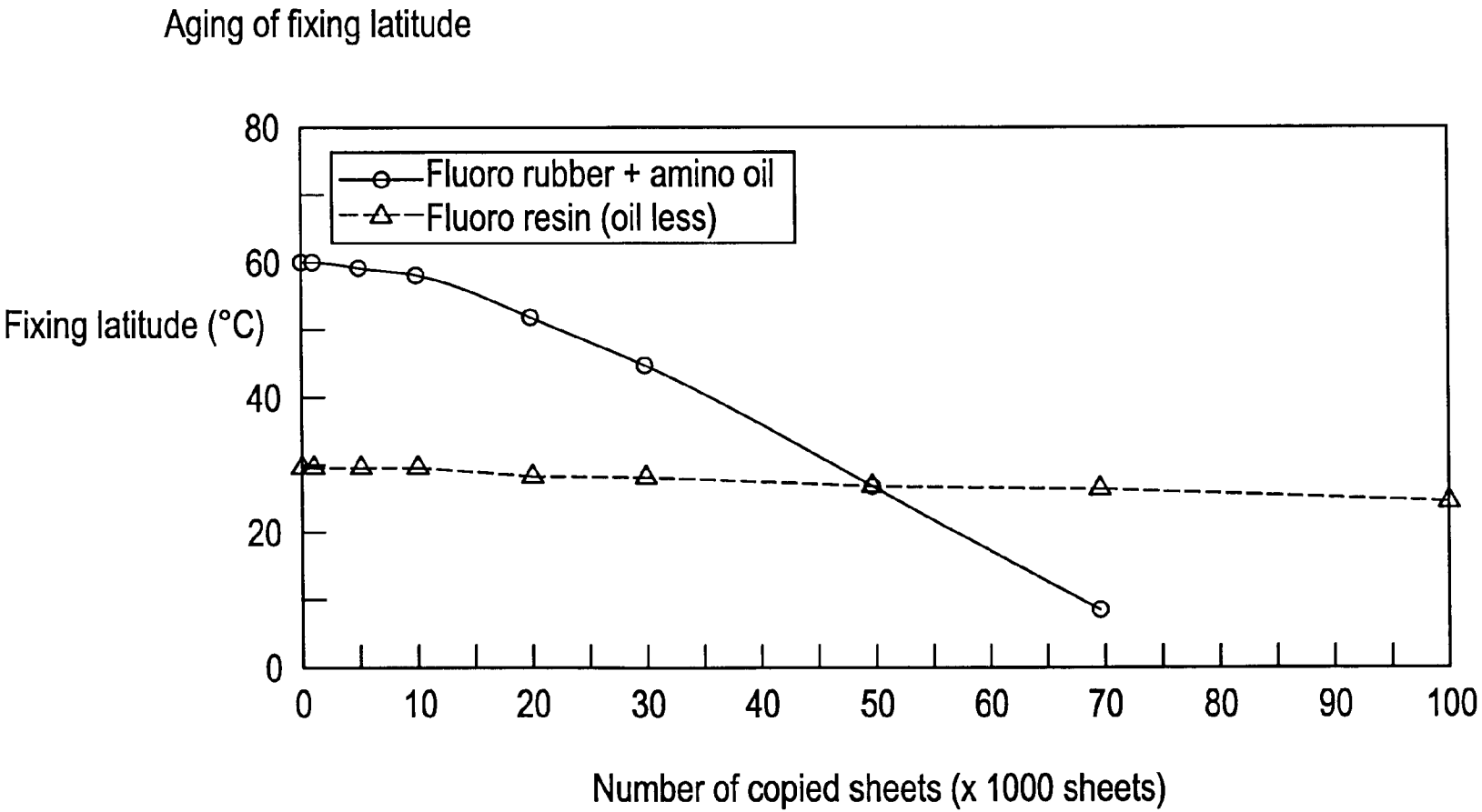
FIG. 6 is a graph showing a fixing latitude due to an increase of copied sheets in image forming apparatuses of the example according to the present invention and the comparative example of the prior art.

Fixing latitude along with increase for the number of copied sheets was examined for each of the image forming apparatus of Example 1-1 and the comparative example. The result is shown in FIG. 6. Comparative Example 1-1 (fluoro rubber roller) has a wide latitude for about 60° C. in an initial stage. It is considered to be attributable to that the fluoro rubber itself is poor in the releasability compared with the fluoro resin, but a releasing agent is coated on the fluoro rubber and, further, a larger effect of distortion (5%) is formed. However, the image forming apparatus of Comparative Example 1-1 showed narrowing for the fixing latitude along with the increase of number of copied sheets. This is considered to be attributable to the frictional abrasion of rubber itself and degradation of the releasability caused by sticking of offset toner and paper dust to the fluoro rubber. The fixing latitude in the image forming apparatus of Comparative Example 1-1 was lowered to about 30° C. after fixing 50,000 copied sheets and further lowered to about 10° C. after fixing 70,000 sheets of copy On the other hand, in Example 1-1 (fluoro resin roller), the fixing latitude is somewhat narrow as about 30° C. in the initial stage compared with Comparative Example 1-1. However, since there is scarce degradation of the releasability in the case of the fluoro resin, change of the fixing latitude is scarcely observed even after fixing 100,000 copied sheets in Example 1-1.

In Example 1-1 and Comparative Example 1-1, since the elastic layer is thin and the temperature lowering is small in the fixing roller, there is no actual problem providing that the fixing latitude is 20° C. Accordingly, while Comparative Example 1-1 can conduct fixing operation only up to about 50,000 copied sheets, whereas fixing operation is possible to 100,000 or more copied sheets in Example 1-1.

Figure 7:
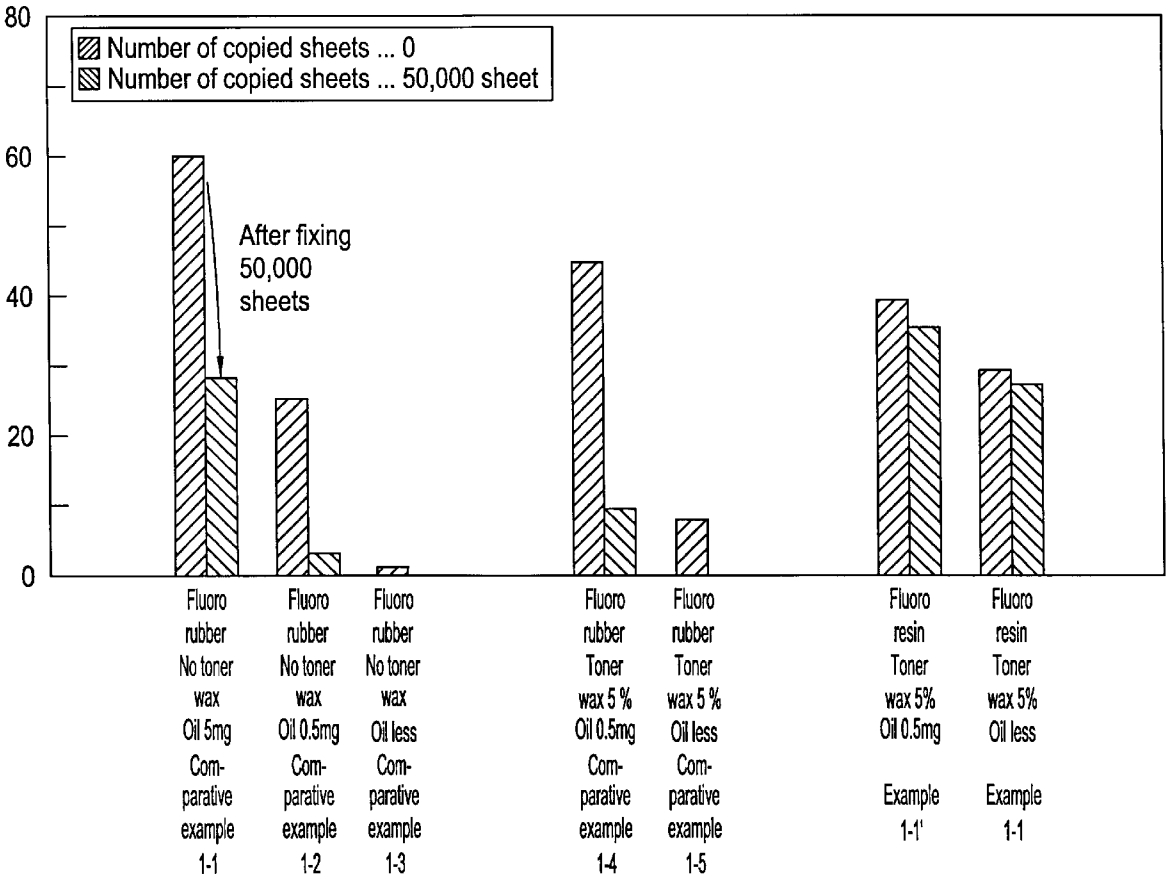
FIG. 7 is a graph showing a fixing latitude at an initial stage and after fixing 50,000 copied sheets in image forming apparatuses of examples according to the present invention and comparative examples of the prior art with respect to each of image forming apparatuses applied with various conditions for the wax content in the toner and the coating amount of a releasing agent (oil) respectively.

Fixing latitude at the initial stage and after fixing 50,000 sheets was examined for each of image forming apparatus (Comparative Examples 1-1 to 1-5), in which the releasing layer 20*c* of the fixing roller 20 was made of fluoro rubber, and to which various conditions were applied while changing the wax content in the toner as 0% and 5% and the coating amount of the releasing agent (oil) as 0 mg (oilless), 0.5 mg and 5 mg, and for the image forming apparatus of Example 1-1 of the present invention. Further, the fixing latitude was also examined in the image forming apparatus of Example 1-1, in which 0.5 mg of oil was coated on the releasing layer of the fixing roller 20 (Example 1-1'). FIG. 7 shows the result.

Generally, the image forming apparatus of the comparative example using the fluoro rubber roller results in remarkable lowering of releasability between the initial stage and after fixing 50,000 sheets. On the contrary, in Examples 1-1 and 1-1' using the fluoro resin roller, degradation of the releasability is scarcely observed between the initial stage and after fixing 50,000 sheets and it can be seen that the reliability is high.

<Confirmation regarding the Thickness of the Releasing layer and Image Quality>

As described above, it has been found that sufficient toner releasability is obtained also in an oilless state by using a PFA tube of 20 μm in thickness for the releasing layer 20*c* of the fixing roller 20. Then, it was confirmed how the image quality is effectuated by the thickness of the PFA tube.

Image quality of the toner after fixing was examined while changing the tube thickness of PFA of the releasing layer 20*c* in Examples 1-1 to 1-5, Comparative Examples 1-6 to 1-7). Evaluation was made by forming a solid image with a toner amount of 0.65 mg/cm$^2$ and conducting functional evaluation for delicate change of gloss. The result is shown in Table 3. The criterion for the evaluation is shown below. For avoiding scattering in evaluation due to the personal difference, it was evaluated by ten persons.

A: substantially uniform (corresponding to image of A Color 620)

B: poor compared with the image of A Color 620 but within an allowable range

C: remarkable unevenness of gloss (corresponding to black-and-white copier)

TABLE 3

| | Thickness of releasing layer 20 c (fluoro resin layer) | | | | | | | |
|---|---|---|---|---|---|---|---|---|
| | 10 μm | 15 μm | 20 μm | 25 μm | 30 μm | 40 μm | 50 μm | In a case of hard roller |
| Evaluation for image quality | A | A | A | B | B | C | C | C |

Generally, unevenness in gloss appears remarkably in a case of using a hard roller, unevenness in gloss occurs also in the case of the fluoro resin layer if the thickness is 40 μm or more. Excellent image quality was obtained with a thickness of the fluoro resin layer of 30 μm or less, and particularly excellent image quality was obtained at a thickness of 20 μm or less.

<Confirmation concerning the Distortion of the Fixing Roller and Fixing Latitude>

Figure 8:
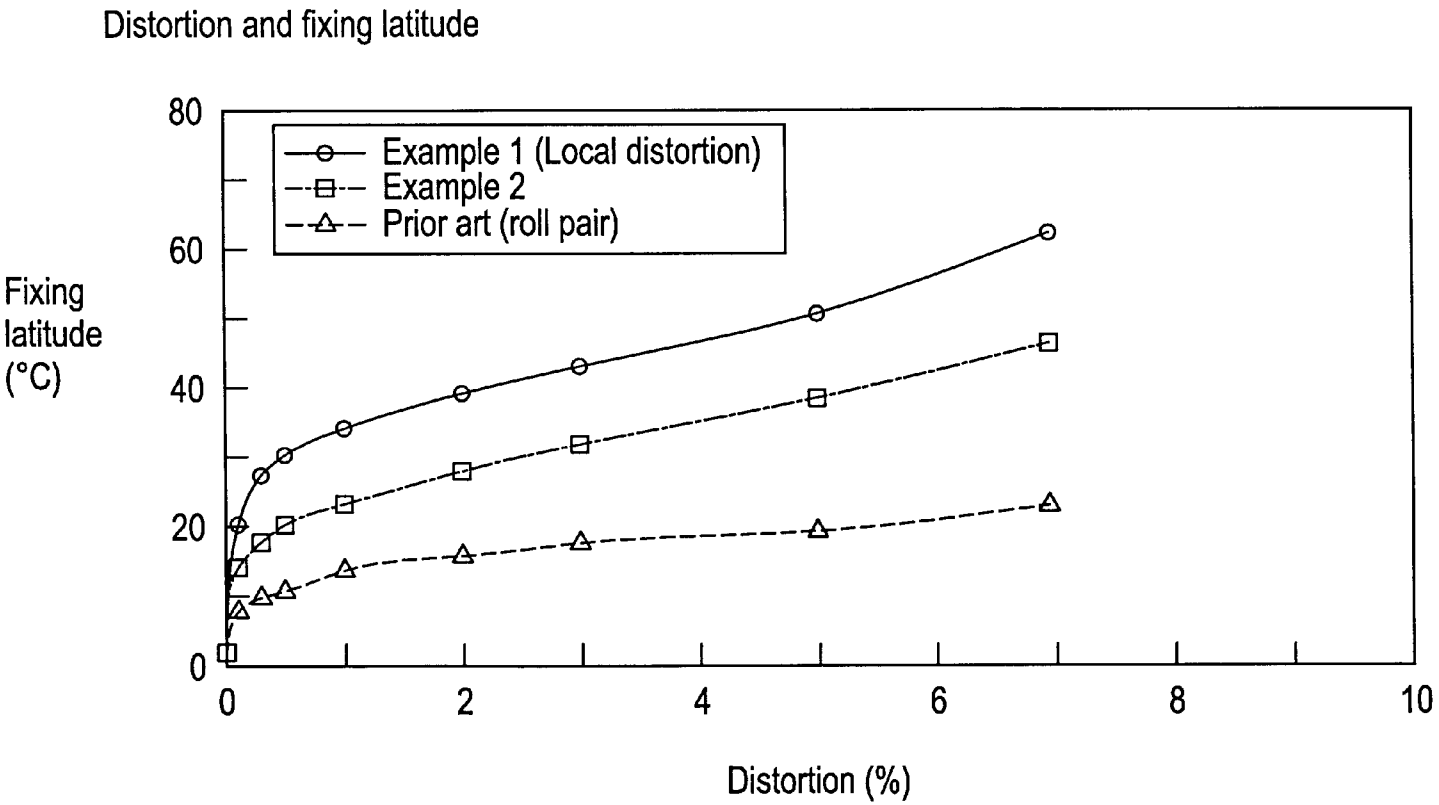
FIG. 8 is a graph showing a relationship between the distortion amount and the fixing latitude in image forming apparatuses of the examples according to the present invention and the comparative example of the prior art.

The fixing latitude was measured while changing the distortion of the fixing roller 20 by varying the total load of Example 1-1 (Example 1-6). The result is shown in FIG. 8. [-○-] shows a case of an image forming apparatus of Example 1-6 and, particularly, plot for 1% distortion shows a case of Example 1-1. As a comparison, a graph for an image forming apparatus of the existent roll pair system (A Color 620) is shown by [---Δ---]. It can be seen that the fixing latitude is widened in both of the cases by increasing the amount of distortion.

When the Example 1-6 and the existent roll pair system are compared, it can be seen that broader fixing latitude is obtained in Example 1-6 for the same distortion. On the contrary, it can be seen that smaller distortion is sufficient in Example 1-6 for obtaining the same level of fixing latitude.

The reason will be considered below.

It is considered that the distortion contributing to the releasing effect is distortion of the fixing roller near the exit of the nip area. Namely, when a recording sheet having a toner image fixed thereon is discharged from the nip area, the distortion (namely, deformation) of the fixing roller tends to resume the original state to cause a microscopic fine slip at the boundary between the surface of the fixed toner image and the surface of the fixing roller, to decrease the adhesion force between the toner image and the fixing roller. Accordingly, it is assumed that as the distortion is larger, the deforming rate upon recovery is greater, and a slip is more liable to occur, so that the releasability is improved.

FIG. 4 shows progress of the distortion in the nip region in the existent roll pair system fixing device and the fixing device in Example 1-6 of the present invention. In the existent roll pair system fixing device, the fixing roller is deformed over the entire nip area in order to ensure the nip width. That is, large distortion is caused also in a region not relevant to the releasing. On the contrary, a nip area is formed by using a flexible belt for ensuring a nip width in the fixing device of this example and somewhat large distortion is applied to the fixing roller only in a region near the exit of the nip area that contributes to the releasability, so that it can be concluded that high releasability can be obtained with small distortion as a whole.

In Example 1-6, releasing effect is developed at distortion of 0.1% and excellent releasability is obtained at 0.3%, and the fixing latitude is broader. Accordingly, it has been confirmed that the distortion is, preferably, 0.1% or more and, more preferably, 0.3% or more.

<Relation between the Film Thickness of the Releasing Layer and the Distortion and Creasing>

Figure 9:
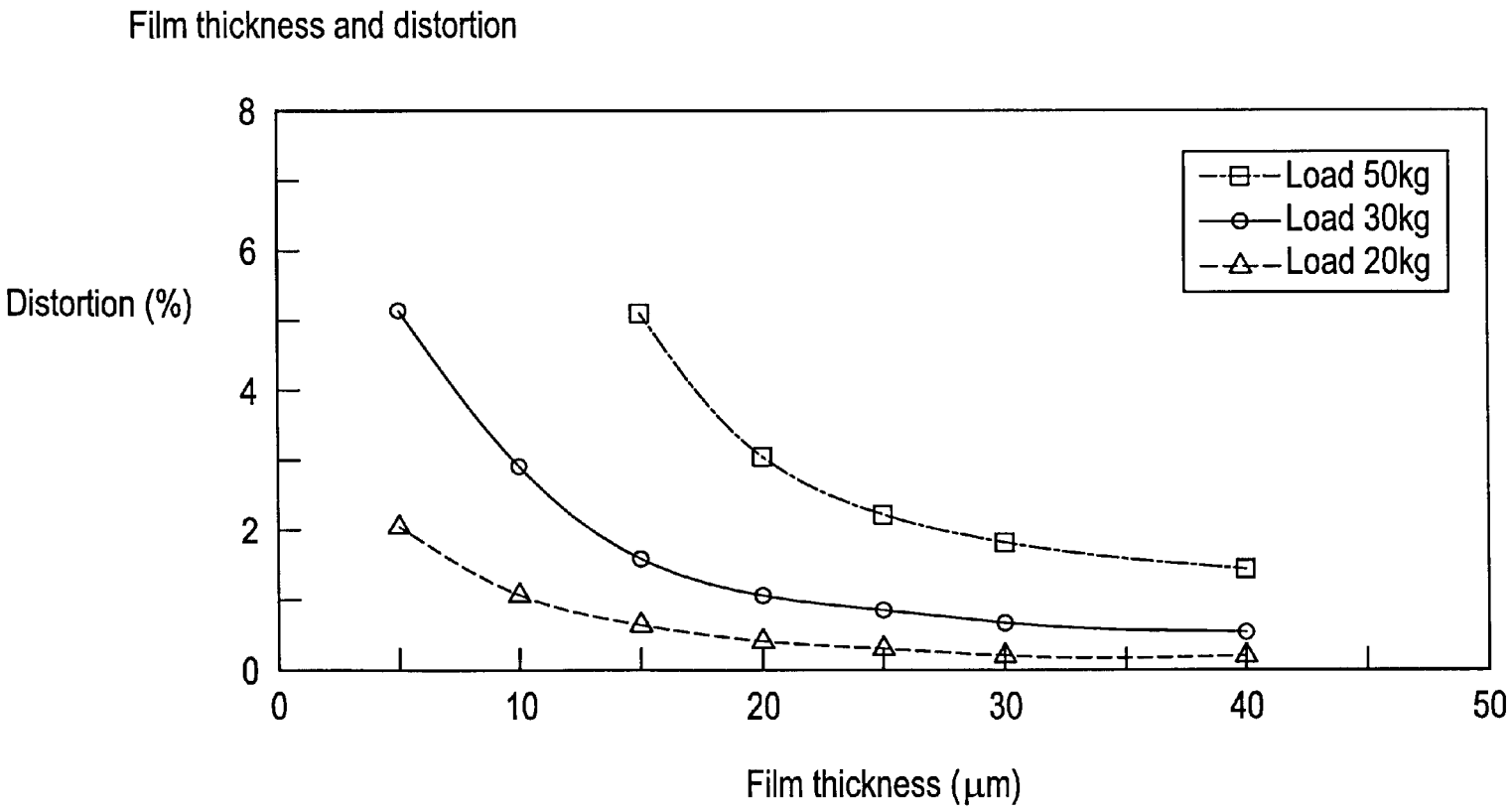
FIG. 9 is a graph showing a relationship between the film thickness of a releasing layer of a fixing roller and the amount of distortion in the image forming apparatus of the example according to the present invention.

At first, relationship between the film thickness of the releasing layer 20*c* and the distortion in the fixing roller 20 was confirmed. The distortion of the fixing roller 20 was measured by applying the pressing force given to the pressure pad 22 of the fixing device in the image forming apparatus of Example 1-1 as 50 kg (Example 1-7), 30 kg (Example 1-8) and 20 kg (Example 1-9) as the total load and, further, by applying appropriately varying the conditions within a range of the thickness of the releasing layer 20*c* from 5 μm to 40 μm, respectively. The result is shown in FIG. 9. In Examples 1-7, the plot for the film thickness 20 μm of the releasing layer 20*c* shows Example 1-1.

It can be seen from FIG. 9 that the distortion is larger as the total load of the pressing force increases and distortion tends to occur more easily as the thickness of the releasing layer 20*c* is reduced at a constant total load.

However, as the thickness of the releasing layer 20*c* is reduced and the distortion of the fixing roller 20 is increased, the reliability of the fixing roller 20 is lowered. Particularly, a thin releasing layer 20*c* (fluoro resin layer) is plastically deformed by elongation due to distortion to result in creasing in the fluoro resin layer. Occurrence of creasing in the releasing layer 20 was examined while properly varying the conditions for the thickness of the releasing layer 20*c* (3 μm–50 μm) and the distortion of the fixing roller 20 (0.5%–7%) in the fixing device of the image forming apparatus of Example 1-1 (Example 1-10). The result is shown in Table 4.

TABLE 4

| | Thickness of releasing layer 20 c (fluoro resin layer) | | | | | | | | |
|---|---|---|---|---|---|---|---|---|---|
| Distortion | 3 μm | 5 μm | 10 μm | 15 μm | 20 μm | 25 μm | 30 μm | 40 μm | 50 μm |
| 0.5% | bad | good | good | good | good | good | good | good | good |
| 1% | bad | bad | good | good | good | good | good | good | good |
| 2% | bad | bad | bad | good | good | good | good | good | good |
| 3% | bad | bad | bad | bad | good | good | good | good | good |
| 4% | bad | bad | bad | bad | bad | good | good | good | good |
| 5% | bad | bad | bad | bad | bad | bad | bad | bad | bad |
| 7% | bad | bad | bad | bad | bad | bad | bad | bad | bad |

good: no creasing formed in the releasing layer 20 c
bad: creasing formed in the releasing layer 20 c As shown in Table 4, at 0.5% distortion of the fixing roller 20, no creasing is formed even if the thickness of the releasing layer 20*c* is 5 μm. However, if the distortion of the fixing roller 20 is 5% or more, creasing is formed even if the thickness of the releasing layer 20*c* is increased to 50 μm. As a result, it can be seen that the distortion should be 4% or less. As confirmed in Example 1-6 described above, since the releasing effect is developed from 0.1% distortion, a preferred range for the distortion is confirmed to be from 0.1 to 4%.

As described above, in a case of using the fluoro resin for the releasing layer of the fixing roll, since no large distortion can be provided, it is impossible to obtain sufficient releasability while suppressing the occurrence of creasing in the existent roll pair system fixing device that requires large distortion for the releasability. Accordingly, when the fluoro resin is used as the releasing layer, it can be said that a constitution of providing local distortion near the exit of the nip as in this example is particularly effective.

<Relation between the Wax Content in the Toner and the Fixing Latitude>

Then, a relation between the wax content in the toner and the fixing latitude was confirmed. The fixing latitude was measured while appropriately varying the conditions for the content of the wax in the toner used in the image forming apparatus of Example 1-1 within a range from 0 to 50% (Example 1-11). The result is shown in FIG. 9. "-○-" indicates an offset forming temperature, and "---Δ---" indicates a lowest fixing temperature and the difference between them is a fixing latitude. The plot for a 5% wax amount in Example 1-11 is a result of Example 1-1.

Figure 10:
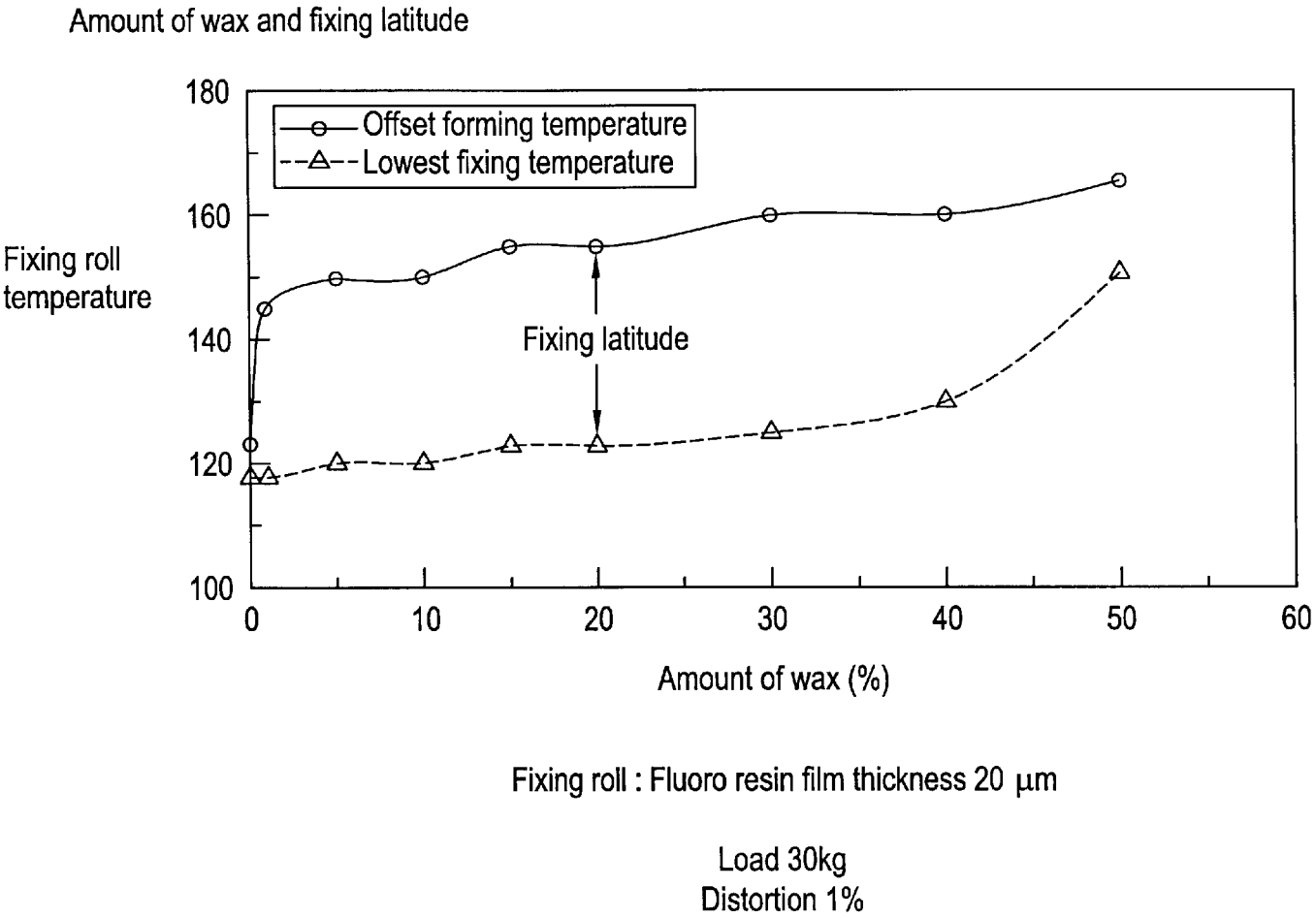
FIG. 10 is a graph showing a relationship between the wax content of the toner and the fixing latitude in the image forming apparatus of the example according to the present invention.

FIG. 10 shows the followings. With addition of 0.1% by weight of wax, the offset forming temperature increases abruptly and, by further addition of wax, the offset forming temperature rises moderately. On the other hand, the lowest fixing temperature rises moderately along with increase of the wax content. Then, if the wax content exceeds 40% by weight, the lowest fixing temperature is extremely increased. Accordingly, it has been confirmed that a broader fixing latitude can be obtained by defining the wax content from 0.1% by weight to 40% by weight or less.

<Relation between the Wax Dispersed Diameter of Wax and OHP Transparency>

A relation between the dispersion diameter of wax and OHP transparency (PE value) when wax is contained in the toner was confirmed. A solid image of toner (thickness: 6.5 μm, 0.65 mg/cm$^2$) was obtained by appropriately varying the conditions for the dispersed diameter of wax in the toner used for the image forming apparatus of Example 1-1 within a range from 0.1 to 4 μm and using a transparency film as a recording sheet.

The OHP transparency of the resultant image was measured (Examples 1-12). The light incident angle was made vertical to the transparency film. The PE value can be determined by the following calculation equation.

$$PE=\log(Ts+Td)/\log Ts$$

where Ts represents a positive transparency and Td represents a diffusion transmittance.

Figure 11:
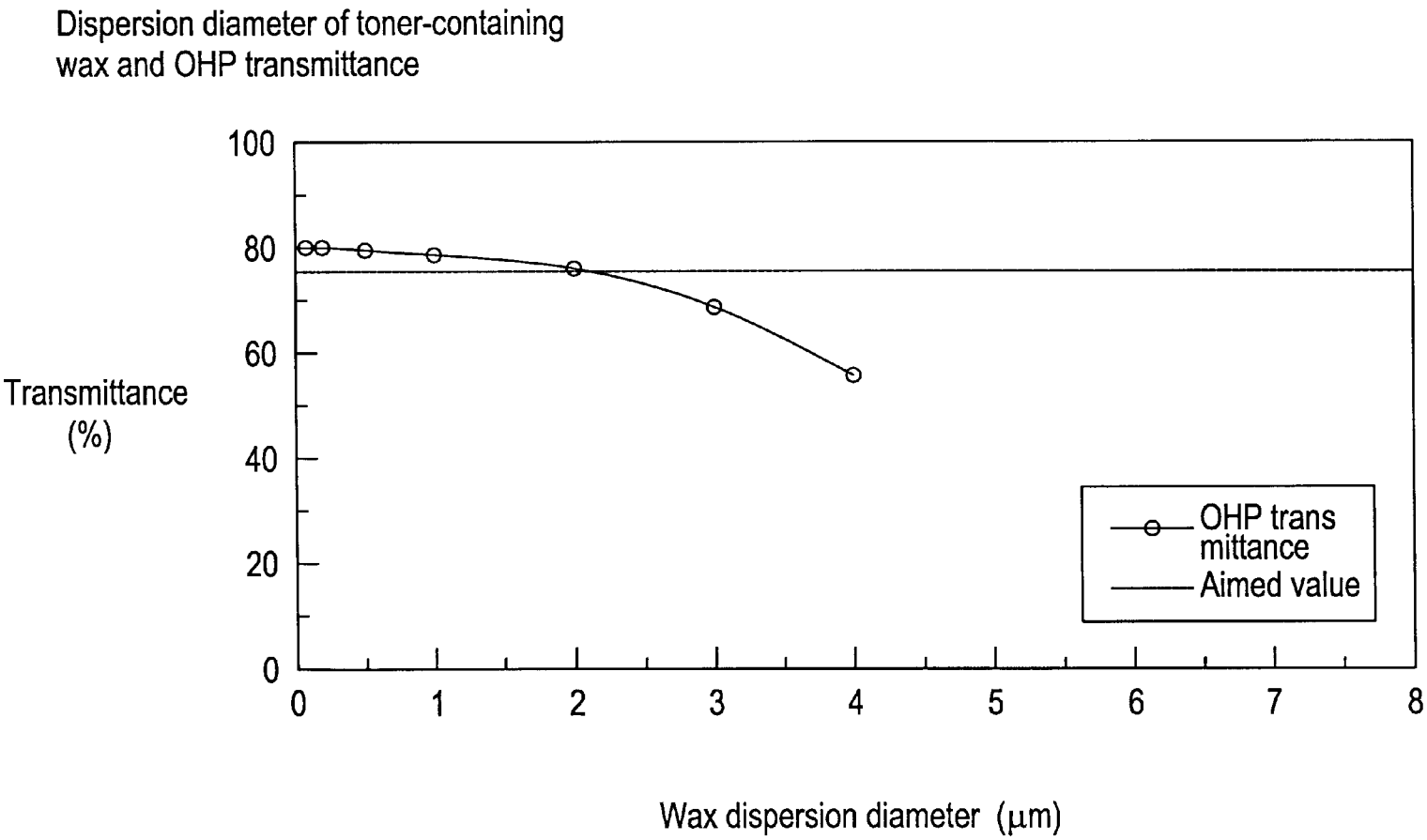
FIG. 11 is a graph showing a relationship between the dispersed diameter of wax and the OHP transmittance in the image forming apparatus of the example according to the present invention.

The result is shown in FIG. 11.

As shown in FIG. 11, it can be seen that the average dispersed diameter of the wax in the toner may be 2 μm or less, more preferably, 1 μm or less.

Example 2

<Specifications for Fixing Device>

In Example (2-1), the fixing device (FIG. 2) of the image forming apparatus of Example 1 was replaced with a fixing device shown in FIG. 1.

The fixing roller 10 and the endless belt 11 have the same constitutions as those of the fixing roller 20 and endless belt 21 in Example 1 respectively, but the constitution of the pressure pad 12 is different from that of the pressure pad 22 in Example 1. A description will be made only about the specifications for the portion different from that of the image forming apparatus of Example 1.

Elastic member 12*a*: silicone rubber having 8 mm width and 50° hardness (JIS-A), a concaved shape (R26 mm) conforming with the outer circumferential surface of the fixing roller 10

Pressing force of the pressure pad 12: total weight 30 kg

Nip width: 4 mm

Pressure distribution in the nip width: the pressure distribution is as shown in FIG. 4 in which about 1% of distortion is given in the same manner as in Example 1-1 but the distortion at the exit of the nip is less than that of Example 1-1 and about equal with that in the existent roll pair type fixing device Distortion of fixing roller 10: about 1%

Circumferential speed of the fixing roller 20: 70 mm/sec

Dwell time in the nip area: 58 msec

Temperature set to the surface of fixing roller 20: 150° C.

In addition, the toner and the releasing film used in this example were identical with those in Example 1-1.

The image forming test was conducted in the same manner as in Example 1-1. As a result of the image forming test, satisfactory copying products with no unevenness in gloss were obtained. Releasability of the recording sheet was also satisfactory. Further, it shows high instant starting performance with no substantial stand-by time.

<Confirmation concerning the Distortion Amount of the Fixing Roller and the Fixing Latitude>

The pressure distribution in the nip of the fixing device in the image forming apparatus of Example 2-1 is as shown in FIG. 4 as described previously, in which about 1% distortion was given like that in Example 1-1 as a whole but the distortion at the exit of the nip is smaller than that in Example 1-1 and about equal with that of the existent roll pair type fixing device (A Color 620).

The fixing latitude was measured while changing the distortion of the fixing roller by changing the total load in Example 2-1 (Example 2-2). The result is shown in FIG. 8. "-.-□-.-" indicates a case of the image forming apparatus of Example 2-2 and, particularly, the plot for 1% distortion indicates the case of Example 2-1.

A shown in FIG. 8, for the identical 1% distortion, while Example 1-1 shows 30° C. fixing latitude at 1% distortion, the distortion was narrowed as 20° C. in Example 2-2 (2-1). However, when comparing with the image forming apparatus of the existent roll pair type (A Color 620), it can be seen that a fixing latitude equal with or more than that in the prior art can be obtained at relatively small distortion in Example 2.

However, since the fixing latitude is narrowed compared with Example 1-1, it is required to control the temperature of the fixing roller 10 at a somewhat higher accuracy compared with Example 1-1. Since the fixing roller 10 is thin and has high heat conductivity, it shows less dross or overshoot.

Example 3

<Specifications of Fixing Device>

In this example, the fixing device (FIG. 2) of the image forming apparatus of Example 1 was replaced with a fixing device shown in FIG. 3. Specifications of this fixing device are as follows:

Core 30*a*: an aluminum cylinder having 48 mm outer diameter and 43 mm inner diameter Heat resistant elastic layer 30*b*: HTV silicone rubber having 1 mm thickness and 50° rubber hardness (JIS-A)

Releasing layer (heat resistant resin layer) 30*c*: PFA tube having 30 μm thickness applied with a primer treatment at the inner surface by etching Output of halogen lamp 34: 650 W Temperature set to the surface of fixing roller 30: 150° C.

Endless belt 31: thermosetting polyimide substrate as a base layer having 70 μm thickness and 188 mm circumferential length on which PFA was coated as a releasing layer to a thickness of 10 μm Tension of endless belt 31: 10 kg Winding angle of the endless belt 31 to the fixing roller 10: 45°

Nip width: about 20 mm

Pressure roll 32: stainless roll having 23 mm diameter

Pressing force of the pressure roll 32: 40 kg

Distortion of the fixing roller 30: about 3%

Circumferential speed of the fixing roller 30: 300 mm/sec

Dwell time at the nip area: 66 msec

Wax-incorporated toner as in Example 1-1 was used for the toner.

The image forming test was conducted in the same manner as in Example 1-1. As a result of the image forming test, satisfactory copying products with no unevenness in gloss were obtained. The releasability of the recording sheet was also satisfactory. Further, it had high instant starting performance with no substantial stand-by time.

Since this Example 3 provided relatively large distortion of about 3%, self stripping was possible and sufficient releasability could be ensured without using the releasing sheet as in Examples 1 and 2.

As described above, toner releasability is excellent and high image quality can be obtained while remarkably reducing or not using at all a releasing agent (oil) which was consumed in a great amount in the existent full color fixing device. Particularly, when a fluoro resin substantially free from degradation is used for the releasing layer of the fixing roller, a fixing device capable of conducting operation stably for a long time is provided. Further, if the oil is not used at all, maintenance for the oil supplement is not necessary anymore.

In addition, since a thin elastic layer can be used and the fixing roller can be reduced in the diameter and in the thickness, the device is excellent in the instant starting performance with short temperature rising time and also in view of energy saving.

What is claimed is:

1. A fixing device comprising:

a heat fixing roller in which a heat resistant elastic layer is formed on a cylindrical metal core and, further, a heat resistant resin layer is formed as coating on the surface thereof, an endless belt, a pressure member disposed in the inside of said endless belt, wherein the endless belt is wound around the heat fixing roller for a predetermined angle to form a nip area between said endless belt and the heat fixing roller for allowing a recording sheet to pass therethrough, the pressure member is pressed by way of the endless belt to the heat fixing roller at the nip area thereby forming distortion in the heat resistant elastic layer of the heat fixing roller.

2. A fixing device as defined in claim 1, wherein the heat resistant resin layer comprises a fluoro resin.

3. A fixing device as defined in claim 1, wherein the pressure member comprises a pressure pad, and the pressure pad is pressed by way of the endless belt to the heat fixing roller thereby forming distortion in the elastic layer of the heat fixing roller.

4. A fixing device as defined in claim 3, wherein a pressure at the nip caused by the pressure pad that presses the fixing roller is locally increased near the exit of the nip area.

5. A fixing device as defined in claim 1, wherein the endless belt is wound around the heat fixing roller for a predetermined angle in a state where the belt is laid around a plurality of support rollers and at least one of the support rollers is pressed, as a pressure roller, to the heat fixing roller by way of the endless belt near the exit of the nip area.

6. A fixing device as defined in claim 1, wherein the distortion of the heat fixing roller in the nip area is from 0.1% to 4%.

7. A fixing device as defined in claim 1, wherein the thickness of the heat resistant resin layer of the fixing roller is from 5 $\mu$m to 40 $\mu$m.

8. A fixing device as defined in claim 1, wherein a releasing sheet having a width of contact which is substantially identical with the axial length of the heat fixing roller is provided, the releasing sheet is situated downstream of the nip area in the rotating direction of the heat fixing roller, and disposed in a direction opposite to the rotating direction of the heat fixing roller and in a state in which the top end and/or the vicinity of the top end thereof is in contact with the outer circumferential surface of the heat fixing roller.

9. A fixing device as defined in claim 8, wherein the releasing sheet uses a heat resistant plastic sheet or a thin metal sheet as a substrate, and both the surfaces and the top end of the substrate are coated with a fluoro resin.

10. An image forming apparatus comprising an electrostatic latent image forming unit that forms electrostatic latent images on an electrostatic latent image support, a developing unit that develops the electrostatic latent images by a toner, a transfer unit that transfers developed toner images onto a recording sheet and a fixing unit that fixes transferred toner images to the recording sheet, wherein the fixing unit is the fixing device as defined in claim 1.

11. An image forming apparatus as defined in claim 10, wherein the toner comprises at least a colorant, a binder resin and 0.1 to 40% by weight of a wax.

12. An image forming apparatus as defined in claim 11, wherein the dispersed diameter of the wax is 2 $\mu$m or less on the number average basis.

13. An image forming apparatus as defined in claim 11, wherein the melting point of the wax is 110° C. or lower.

14. An image forming apparatus as defined in claim 11, wherein the latent heat of melting of the wax is 230 mJ/mg or less.

15. An image forming apparatus as defined in claim 10, wherein at least a portion of the binder resin in the toner comprises a mixture of a linear polymer having a weight average molecular weight of 2,000 to 50,000 and a non-linear polymer having a weight average molecular weight of 2,000 to 50,000 in which the mixing ratio (linear polymer: non-linear polymer, weight ratio) is 40:60 to 99:1.

16. An image forming apparatus as defined in claim 15, wherein the glass transition point of the linear polymer in the binder resin is from 40 to 80° C. and the difference of the glass transition point thereof with that of the non-linear polymer in the binder resin is 20° C. or less.

17. An image forming apparatus as defined in claim 15, wherein the softening point of the linear polymer in the binder resin is from 90 to 120° C. and the difference of the softening point thereof with that of the non-linear polymer is 20° C. or less.

18. An image forming apparatus as defined in claim 15, wherein the linear polymer and non-linear polymer are polyester.

* * * * *